US006071098A

United States Patent [19]

Richards

[11] Patent Number: 6,071,098

[45] Date of Patent: Jun. 6, 2000

[54] ROTARY INTERNAL COMBUSTION ENGINES

[76] Inventor: Ronald Leslie Richards, 49 Affleck Street, Alderley, Queensland 4051, Australia

[21] Appl. No.: 08/883,540

[22] Filed: Jun. 26, 1997

Related U.S. Application Data

[63] Continuation of application No. PCT/AU96/00584, Sep. 16, 1996.

[30] Foreign Application Priority Data

Sep. 19, 1995 [AU] Australia ..... PN 5504
Sep. 19, 1995 [AU] Australia ..... PN 5505

[51] Int. Cl.[7] ..... F01C 1/07
[52] U.S. Cl. ..... 418/36; 418/37
[58] Field of Search ..... 418/36, 37

[56] References Cited

U.S. PATENT DOCUMENTS

| | | | |
|---|---|---|---|
| 1,112,734 | 10/1914 | Vincent . | |
| 1,298,839 | 4/1919 | Weed . | |
| 1,299,588 | 4/1919 | Luikart . | |
| 1,497,481 | 6/1924 | Bullington | 418/37 |
| 1,644,564 | 10/1927 | Bullington . | |
| 1,944,875 | 1/1934 | Bullington | 286/7 |
| 1,973,397 | 9/1934 | Stromberg | 123/11 |
| 2,020,089 | 11/1935 | Weed | 123/11 |
| 2,544,480 | 3/1951 | Bancroft | 418/37 |
| 2,731,000 | 1/1956 | Pelhat | 123/11 |
| 2,804,059 | 8/1957 | Honjyo | 123/11 |
| 2,971,500 | 2/1961 | Bancroft | 123/11 |
| 3,244,156 | 4/1966 | Curtiss | 123/11 |
| 3,304,921 | 2/1967 | Prochazka et al. | 123/11 |
| 3,645,239 | 2/1972 | Cena | 123/8.07 |
| 3,739,755 | 6/1973 | Folstadt | 123/43 B |
| 3,822,971 | 7/1974 | Chahrouri | 418/36 |
| 3,885,532 | 5/1975 | Pike | 123/43 B |
| 3,922,118 | 11/1975 | Bancroft | 418/37 |
| 3,990,405 | 11/1976 | Kecik | 123/8.13 |
| 4,010,716 | 3/1977 | Minka | 123/8.47 |
| 4,026,249 | 5/1977 | Larrea | 123/8.47 |
| 4,057,039 | 11/1977 | Pinto | 123/43 B |
| 4,084,550 | 4/1978 | Gaspar | 123/245 |
| 4,086,879 | 5/1978 | Turnbull | 123/216 |
| 4,359,980 | 11/1982 | Somraty | 123/245 |
| 4,553,503 | 11/1985 | Cena | 123/18 A |
| 4,949,688 | 8/1990 | Bayless | 123/245 |
| 5,192,201 | 3/1993 | Beben | 418/38 |
| 5,199,391 | 4/1993 | Kovalenko | 123/43 B |

FOREIGN PATENT DOCUMENTS

| | | |
|---|---|---|
| 26234/30 | 4/1930 | Australia . |
| 2498248 | 7/1982 | France . |
| 3521593 A1 | 1/1987 | Germany . |
| WO 95/34750 | 12/1995 | WIPO . |
| WO 96/18024 | 6/1996 | WIPO . |

OTHER PUBLICATIONS

"Wankel Engine Design Development Applications," 3rd printing Feb. 1975, pp. 501–511.

"Patent Abstracts of Japan," No.JP55–139901(A), M–50 p. 139 (Nov. 1, 1980).

*Primary Examiner*—John J. Vrablik
*Attorney, Agent, or Firm*—Holland & Knight LLP

[57] ABSTRACT

A toroidal engine [20] is provided having opposed rotor assemblies [45] supporting pistons [47] arranged on each rotor assembly [45]. Part toroidal working chambers are formed between the pistons [47] in which a combustible mixture of air and fuel is compressed and then ignited at minimum working chamber volume forcing the then active pistons [47] and rotor assemblies [45] to accelerate. The rotor assemblies drive a planetary member [50] for rotation about its axis through a sliding pin connection [56]. The or each planetary member [50] is supported on a crankpin [51] of a crankshaft [40] and is integral with a planet gear meshed with a sun/annulus gear [53] centered on the crankshaft axis. The crankshaft [40] may be arranged to counter-rotate relative to the rotor assemblies [45] by meshing the planetary member gear [52] with an annulus gear [53] or in the same direction by meshing with a sun gear.

30 Claims, 25 Drawing Sheets

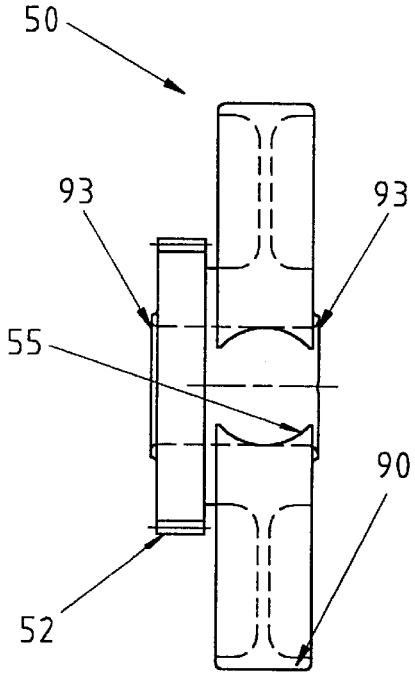
SECTION 9-9
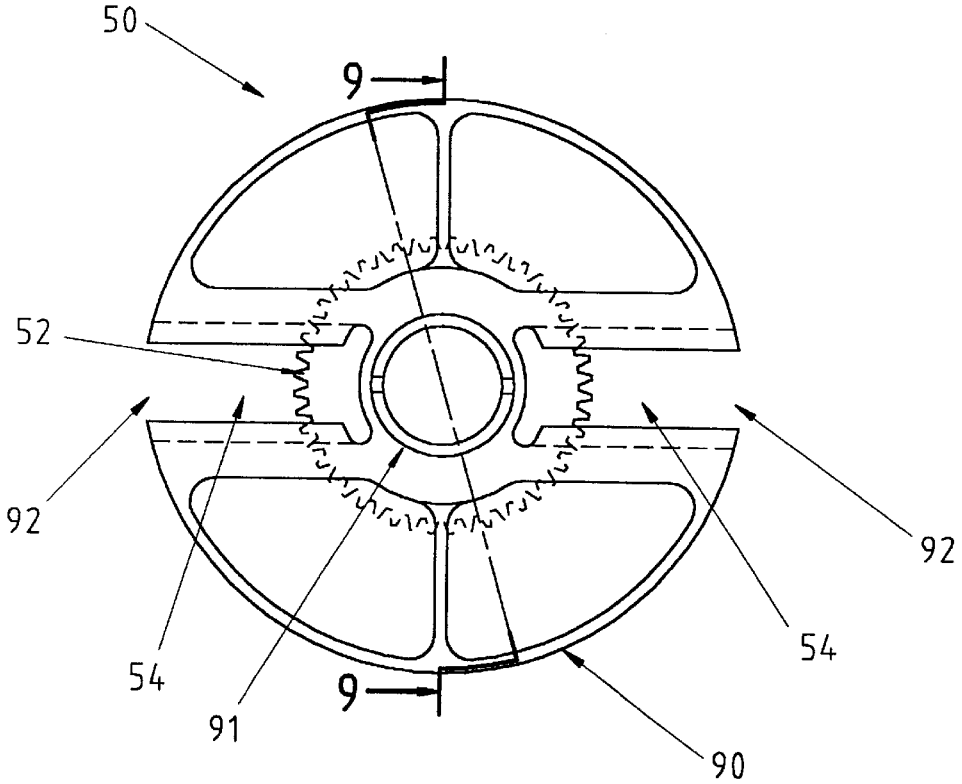
FIGURE 9

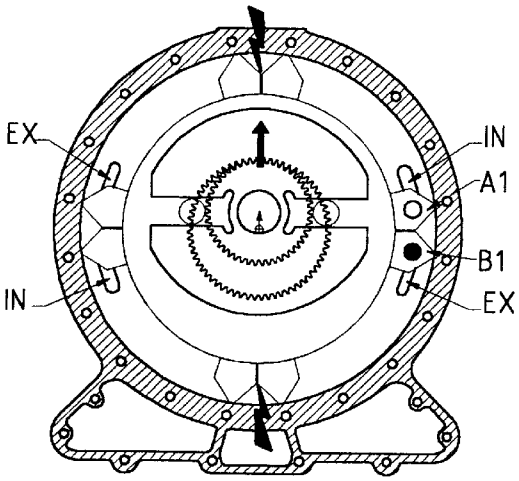
Fig 14a 0° CRANK ROTATION
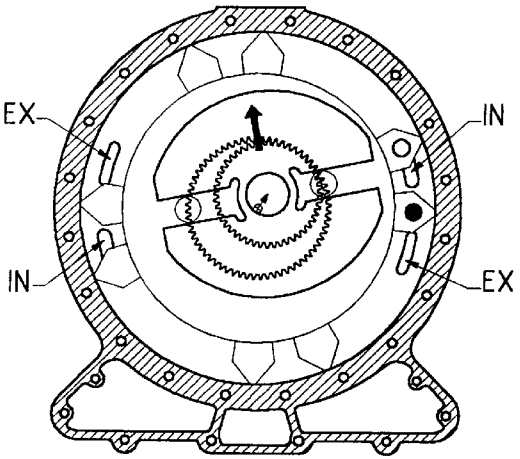
Fig 14b 33.75° CRANK ROTATION
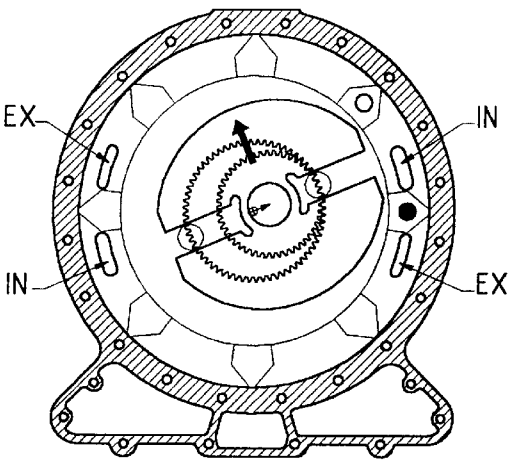
Fig 14c 67.5° CRANK ROTATION
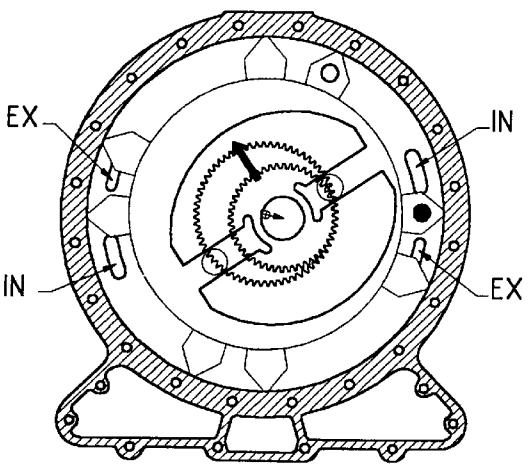
Fig 14d 101.25° CRANK ROTATION
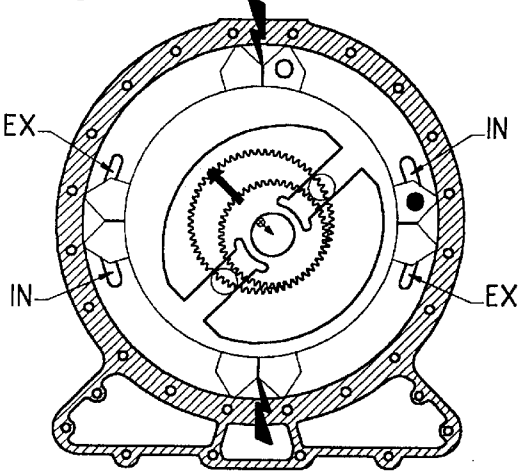
Fig 14e 135° CRANK ROTATION
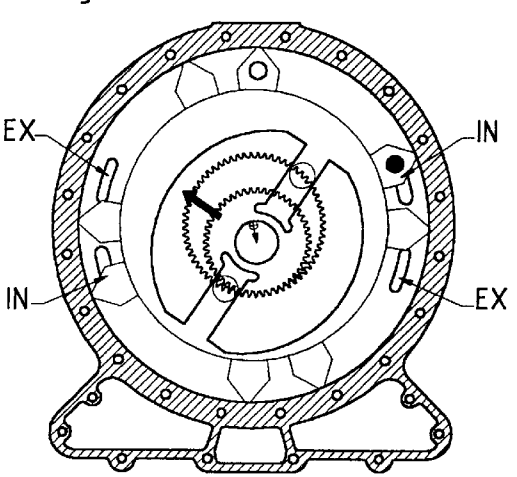
Fig 14f 168.75° CRANK ROTATION

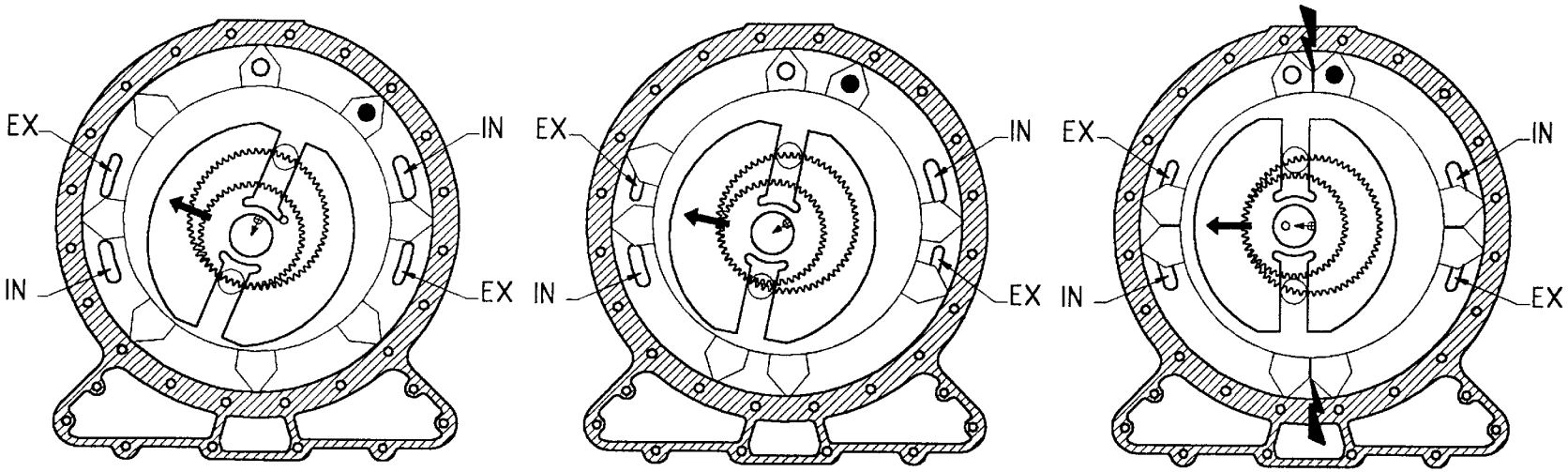
Fig 14g 202.5° CRANK ROTATION
Fig 14h 236.25° CRANK ROTATION
Fig 14i 270° CRANK ROTATION
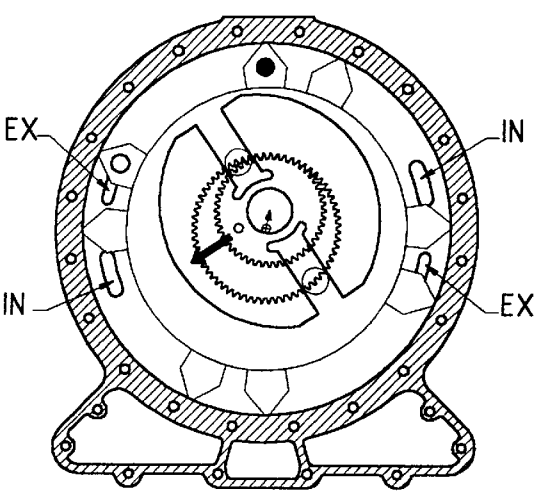
Fig 14j 303.75° CRANK ROTATION
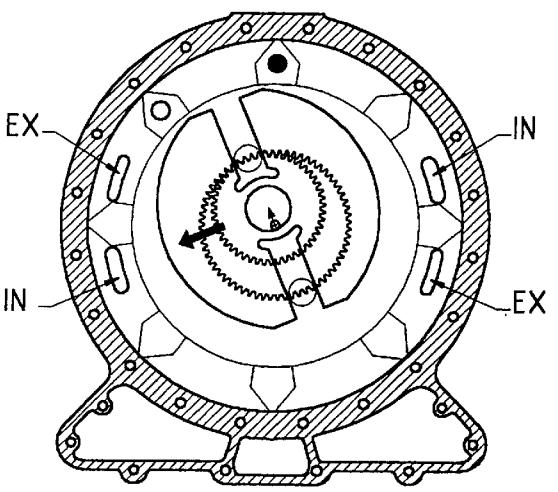
Fig 14k 337.5° CRANK ROTATION
Fig 14l 371.25° CRANK ROTATION

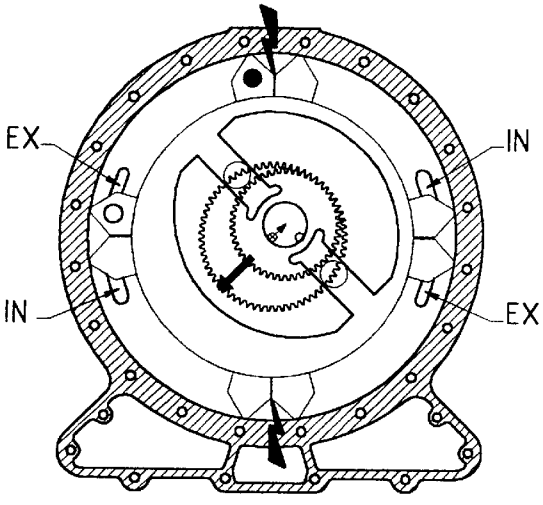
Fig 14m 405° CRANK ROTATION
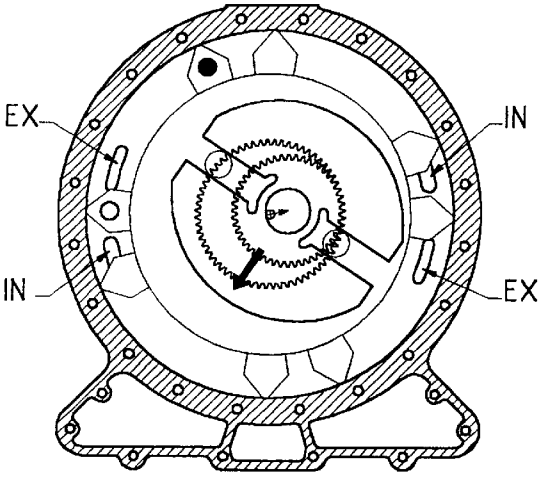
Fig 14n 438.75° CRANK ROTATION
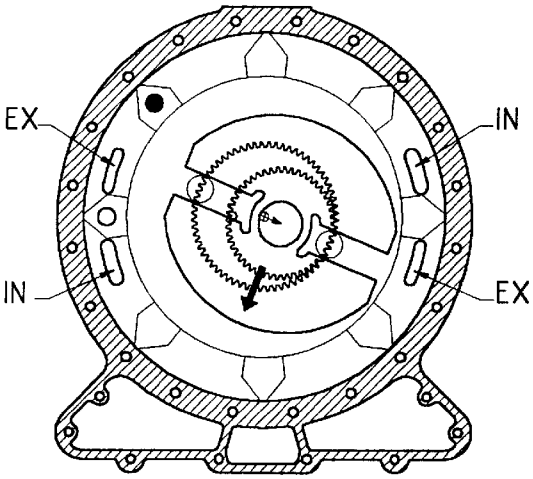
Fig 14o 472.5° CRANK ROTATION
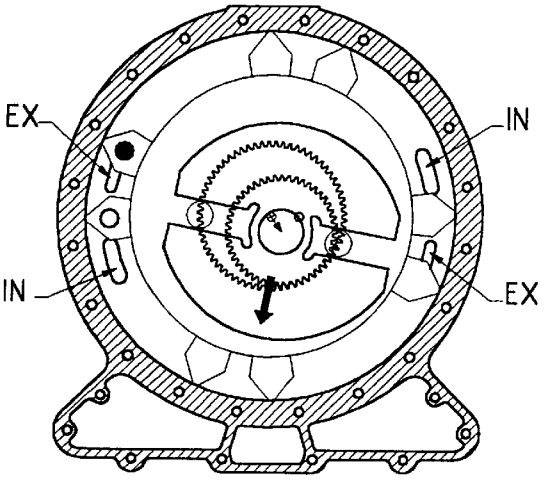
Fig 14p 506.25° CRANK ROTATION
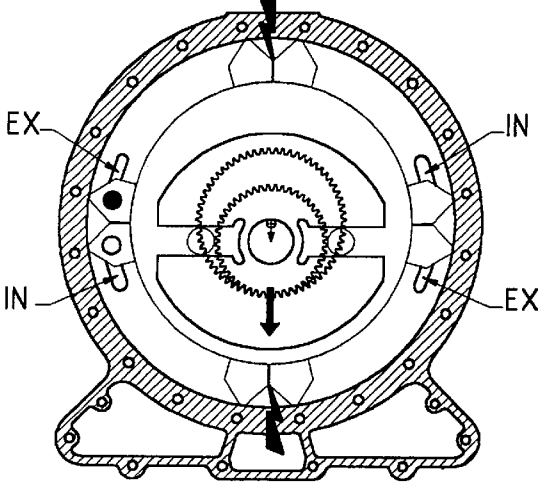
Fig 14q 540° CRANK ROTATION
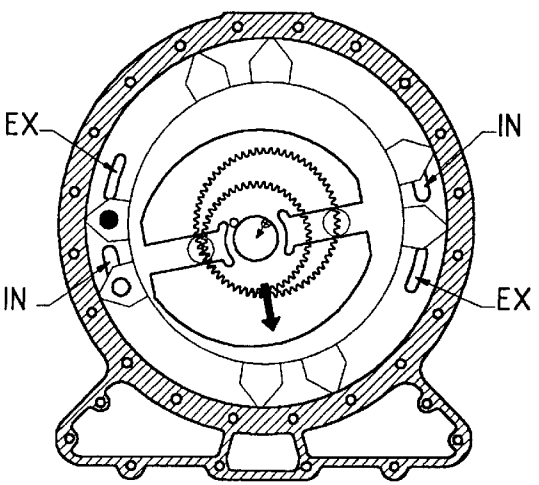
Fig 14r 573.75° CRANK ROTATION

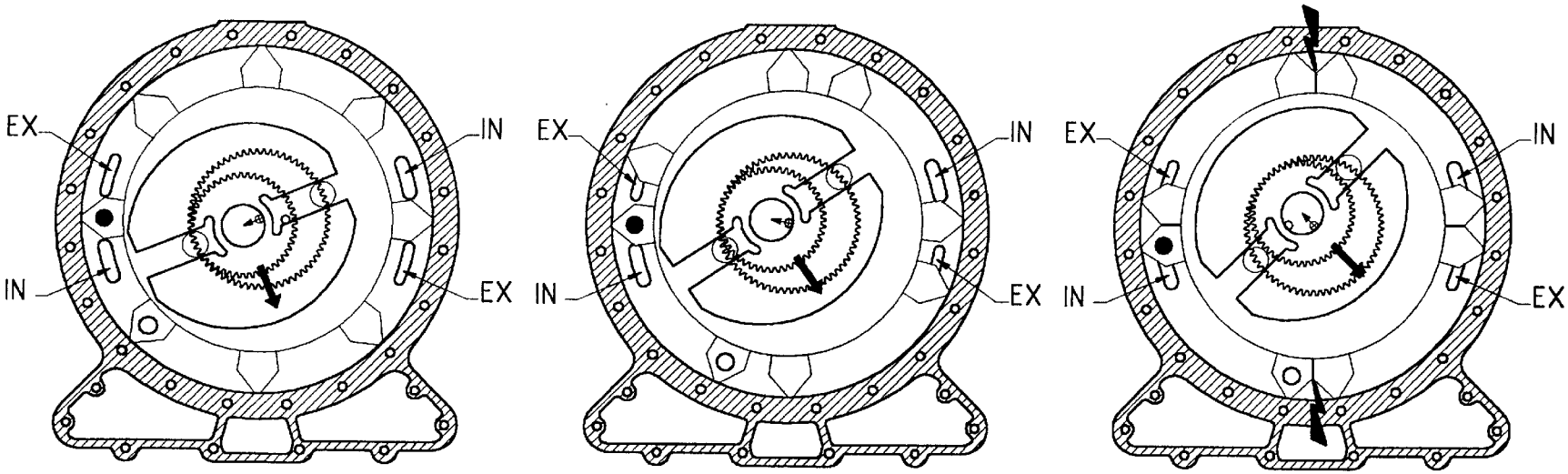
Fig 14s 607.5° CRANK ROTATION
Fig 14t 641.25° CRANK ROTATION
Fig 14u 675° CRANK ROTATION
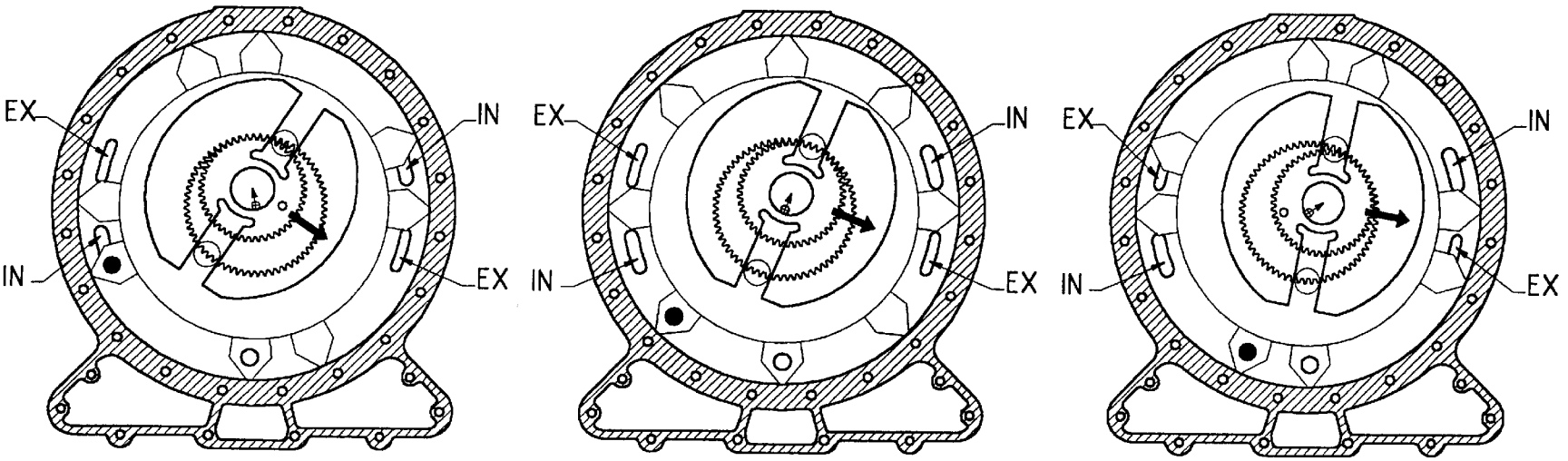
Fig 14v 708.75° CRANK ROTATION
Fig 14w 742.5° CRANK ROTATION
Fig 14x 776.25° CRANK ROTATION

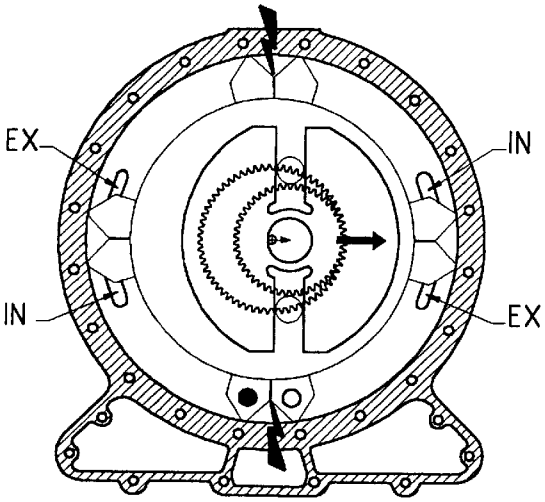
Fig 14y 810° CRANK ROTATION
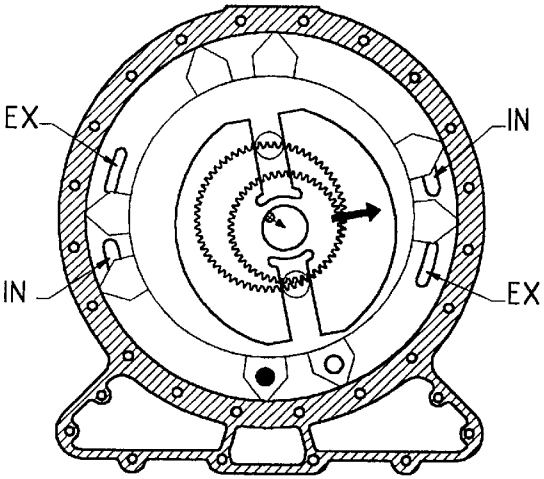
Fig 14z 843.75° CRANK ROTATION
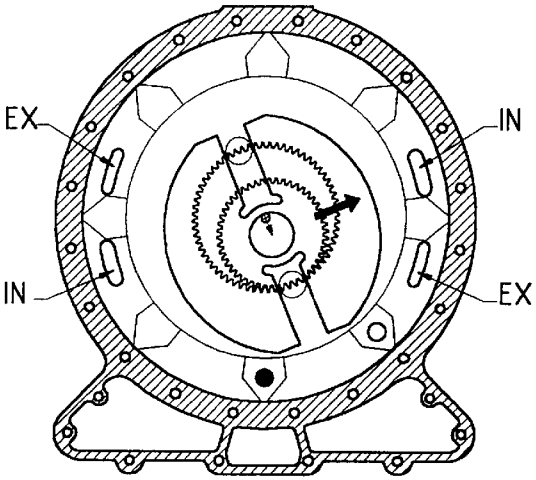
Fig14aa 877.5° CRANK ROTATION
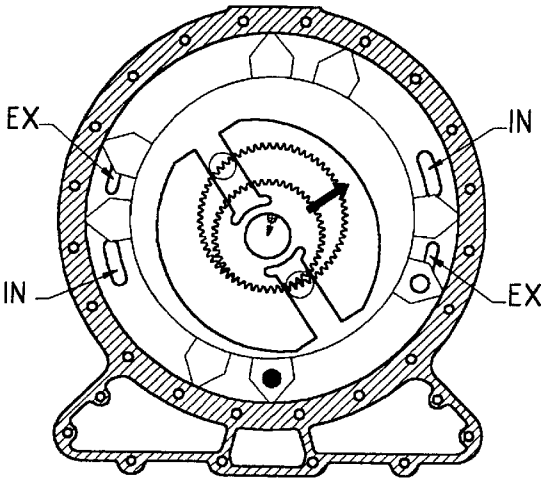
Fig 14bb 911.25° CRANK ROTATION
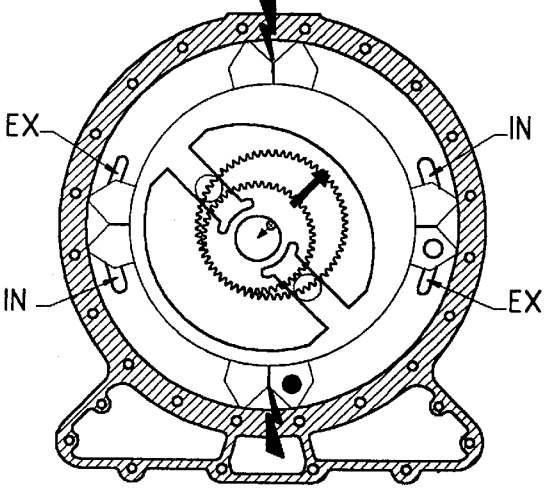
Fig 14cc 945° CRANK ROTATION
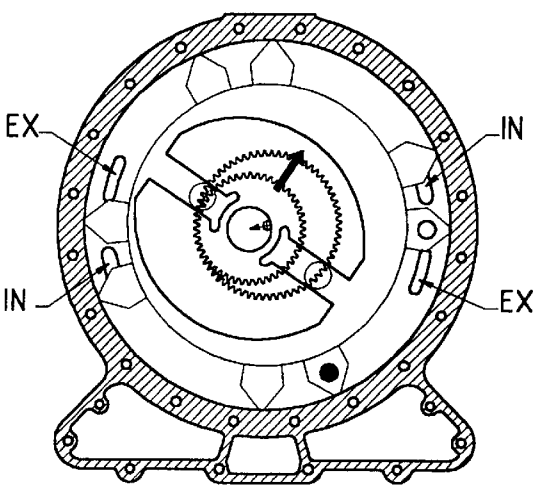
Fig 14dd 978.75° CRANK ROTATION

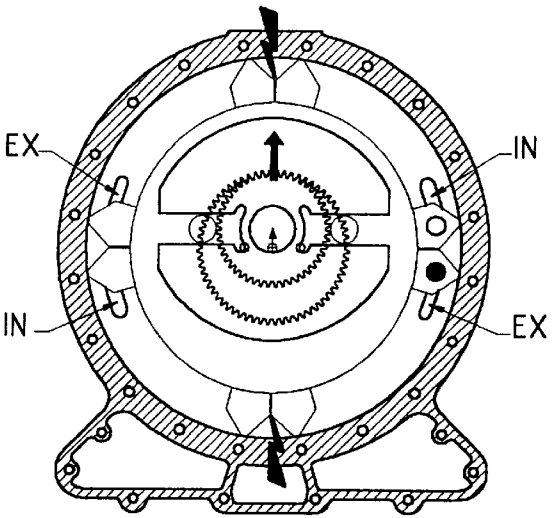
Fig 14gg 1080° CRANK ROTATION
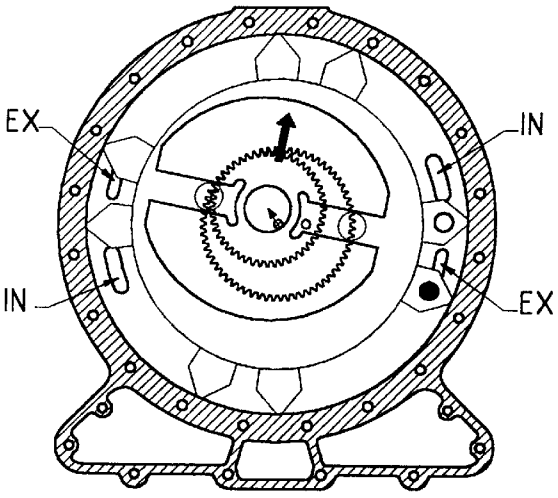
Fig 14ff 1046.25° CRANK ROTATION
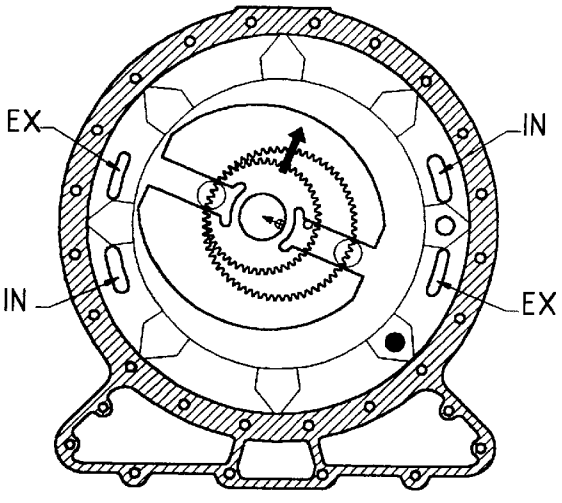
Fig 14ee 1012.5° CRANK ROTATION

ROTARY INTERNAL COMBUSTION ENGINES

This application is a continuation of International Application No. PCT/AU96/00584 filed Sep. 16, 1996.

This invention relates to rotary internal combustion engines. This invention also relates to rotary positive displacement apparatus such as fluid pumps and engines that utilise a toroidal cylinder for the working chambers.

Such internal combustion engines, fluid driven motors, fluid pumps and external combustion engines are hereinafter collectively referred to as toroidal engines. However, for illustrative purposes this invention will be exemplified hereinafter by reference to its internal combustion engine application.

Many forms of rotary engines have been contemplated and manufactured. Mostly they have been proposed as a means of reducing the inherent disadvantages associated with conventional reciprocating piston engines, and/or with a view to providing a compact or lightweight engine which is economical to manufacture and fuel efficient. To date these have not been commercialised. The only internal combustion engines which are mass produced are the Wankel rotary engine and the conventional reciprocating piston engine.

Conventional reciprocating pumps and engines have been universally utilised due to their efficient and simple conversion of reciprocating motion of the pistons, to a rotary motion via a crankshaft. However, conventional reciprocating internal combustion engines have fuel consumption limitations imposed by friction due to the multiplicity of moving parts. These moving parts generally include the bearing journals where friction increases with the speed of rotation and the number of bearings, the piston rings that impose friction by the plurality of rings on each piston, and the valve train where numerous components operate as a combined system that contributes significant friction to the engine as a whole.

In addition, thermal efficiencies of reciprocating internal combustion engines are reduced by the design of the mechanical components, the materials used, the manner of operation and, the use of a common cylinder portion for all the cycle phases. Fuel efficient conventional reciprocating internal combustion engines do exist but are highly complex units. Such complexity increases manufacturing and assembly costs.

The Wankel engine has found application in motor vehicles because of its high performance potential. However, for various reasons it has not been utilised for general use as a replacement for conventional piston engines such as commuter vehicles or mass produced small industrial engines.

Other forms of rotary engines have also been proposed. These include toroidal engines having a toroidal cylinder formed in the cylinder housing about a driveshaft assembly, rotor means supported for rotation about the driveshaft and coupled to pistons in the toroidal shaped cylinder whereby the pistons move cyclically toward and away from one another forming expanding and contracting working chambers therebetween within the toroidal cylinder, and, inlet and outlet ports extending through the cylinder housing assembly for entry and exit of fluid to and from the working chambers.

Typical prior art of toroidal engines are outlined in "THE WANKEL ENGINE DESIGN DEVELOPMENT APPLICATIONS" by Jan P Norbye published by the Chilton Book Company. French Patent No. 2498248 to Societe Nationale D'Etude et de Construction de Moteurs D'Aviation Snecma, and German patent No. 3521593 to Gebhard Hauser also illustrate prior art toroidal engines. Some of these engines utilise external mechanisms to effect the cyclic motion of the pistons, which move within the cylinder, while others utilise swash plates and cams and the like in the power train to achieve the desired mechanical coupling of the drive components.

For the purpose of mass production, it is considered that all this prior art has disadvantages either in inefficient configurations in terms of operation, or the ability to perform satisfactorily under normal working loads such as sustained optimum power delivery. Many of the prior proposals also require sophisticated manufacturing or assembly processes, are difficult to seal, are overly complex, or operate in an inefficient manner.

The present invention aims to provide toroidal engines which will alleviate at least one of the disadvantages outlined above.

With the foregoing in view, this invention in one aspect resides broadly in rotary positive displacement apparatus of the type having a toroidal cylinder formed in a cylinder housing assembly about a driveshaft with its axis concentric with the axis of the toroidal shaped cylinder and coupled to juxtaposed rotor assemblies having pistons in the toroidal shaped cylinder whereby rotation of the driveshaft rotates the rotors in a manner which causes the pistons to move cyclically toward and away from one another during their rotation, forming expanding and contracting working chambers therebetween within the toroidal cylinder and inlet and outlet port means extending through the cylinder housing assembly for entry and exit of fluid to and from the working chambers, and wherein the coupling means coupling the pistons in the toroidal shaped cylinder to the driveshaft includes:

- drive means for coupling one rotor assembly to the driveshaft;
- a crankpin offset from the driveshaft;
- a planetary member driven for rotation about the crankpin at a predetermined rotational speed relative to the driveshaft whereby the planetary member is supported on the crankpin for epicyclic movement about the driveshaft, and
- a direct drive connection between the other rotor assembly and the planetary member offset from their respective axes whereby the differential angular velocity of the direct drive connection about the driveshaft axis resultant from its epicyclic motion thereabout causes the pistons of the other rotor assembly to move cyclically toward and away from the pistons of the one rotor assembly as it rotates about the driveshaft.

The driveshaft may rotate in the same direction as the rotor assemblies but for most applications as an internal combustion engine it is preferred that the driveshaft is constrained to counter-rotate relative to the rotor assemblies whereby the speed of rotation of the rotor assemblies may be reduced relative to the speed of rotation of the driveshaft.

The drive means for rotating the planetary member about its orbiting axis may include a chain or toothed belt passing from a driven sprocket/pulley mounted on the planetary member concentric with the orbiting axis and about a drive sprocket/pulley mounted on the cylinder housing assembly. Alternatively the drive means may include a gear mounted on the planetary member and meshing internally or externally or indirectly through a gear train with a sun gear/annulus gear fixed to the cylinder housing assembly. Thus the planetary member may rotate with a planetary gear driven from a fixed sun gear co-axial with the driveshaft for rotating in the same direction as the rotor assemblies.

In the preferred form the planetary member rotates with a planetary gear driven from an annulus gear co-axial with the driveshaft whereby the driveshaft counter-rotates relative to the rotor assemblies.

The planetary member may be in the form of a lobed member constrained for epicyclic motion with respect to the driveshaft axis and cooperating directly with complementary lobes associated with the cylinder housing assembly. For example in an eight piston version the planetary member may be a six lobed member meshing externally with an eight lobed housing portion.

Preferably the driveshaft extends through the rotor assemblies and is mounted rotatably in bearings in the cylinder housing assembly at opposite sides of the rotor assemblies. The planetary member may be constrained for rotation about the driveshaft axis by being supported on a track formed in the support assembly and extending about the driveshaft, or on a crank type mounting rotatable about the driveshaft axis. Preferably however the driveshaft is in the form of a crankshaft forming the crankpin intermediate its mountings in the cylinder housing assembly and the planetary member is supported on the offset crankpin. Furthermore it is preferred that the crankshaft be formed with an intermediate floating journal on which the rotor assemblies are mounted.

It is also preferred that the direct drive connection is a drive pin which is located fixedly in one of either the planetary member or the other rotor assembly and which is slidable in the other to permit the epicyclic motion of the planetary member and whereby the load transfer between the fixedly located drive pin and either the planetary member or each rotor assembly is effected by transferring loads in a substantially straight load path through its slidable connection thereto. That is the load transfer is effected without the requirement of an interposed linkage or mechanism and it may thus be more robust, simpler, compact and reliable. Furthermore the direct drive connection enables all the mechanical workings to be constrained inwardly of the toroidal cylinder, the diameter of which is limited by sensible proportions and engine capacity, without sacrificing strength and durability.

In a preferred form the planetary member is in the form of a drive yoke rotatable about the crankpin and having low friction slide means thereon extending away from the crankpin and engaged directly with the drive pin whereby the load transfer between the drive pin and the planetary member is transferred along a substantially straight load path through its slidable engagement with the planetary member.

The slide means could provide a non-linear slide path if desired but preferably the slide means extends radially away from the crankpin. The slide means suitably includes a radially extending slot in the drive yoke and a slide block freely slidable along the slot and carrying an axially extending drive pin which engages with the other rotor assembly. Preferably the slide block nests within a slot having a part circular profile whereby it is held captive in the slot, and in a preferred form the slide block is formed from a low friction material such as a ceramic material. If desired, the drive pin could engage directly in a rectangular sectioned slot or recess. Additionally, the drive pin could be integral with the slide block and/or the rotor assembly, but suitably the drive pin is a separate pin received rotatably in the slide block and the rotor assembly.

One of the rotor assemblies could be coupled to the driveshaft for rotation at a constant relative angular speed such that only the other rotor assembly oscillates relative to that one rotor to form the varying working chamber. It is preferred however that both rotor assemblies are coupled to the driveshaft in a corresponding manner.

In an internal combustion engine according to this invention, it is preferred that the pistons on the respective rotor assemblies alternately act as active and reactive pistons. In order to achieve the same dynamic loads for each rotor assembly when in their respective active or reactive phase, it is preferred that each drive yoke is formed with respective slide means extending radially away from diagonally opposite sides of the crankpin and that the respective drive pin thereof engages with a respective rotor assembly. This will cause the differential angular velocities of the opposed drive pins to move the active pistons cyclically away from the reactive pistons during an induction or expansion cycle and simultaneously cyclically toward the reactive pistons during a compression or exhaust cycle.

Furthermore, arranging the coupling means such that the coupled rotors are driven identically and out of phase has the advantage of maintaining an inertia balance of the components and equivalence of physical characteristics for all cycle phases. This is further assisted by the resultant near sinusoidal oscillating action of the rotors. In order to provide a more robust engine, the drive pins may extend through the rotor assemblies for direct coupling to corresponding drive yokes mounted at opposite sides of the rotor assemblies.

Suitably, the housing portions each form a complementary side portion of the toroidal housing and a respective portion of the annular access opening thereto. However this access opening could be formed in one housing portion if desired.

The number of pistons for each rotor of the rotary positive displacement apparatus may vary from a minimum of one per rotor. The engine may operate as a two stroke/cycle type engine or a four stroke/cycle type engine. Preferably, each pair of rotors has at least the number of pistons which corresponds to the number of cycles of the engine type with increases in piston numbers being in multiples thereof, for each pair of rotors. That is, for a two stroke/cycle type engine the total number of pistons may be 2,4,6,8 etc. whereas for a four stroke/cycle type engine the total number of pistons may be 4,8,12,16 etc. It is also preferred that the inlet and outlet port means comprises, for each minimum preferred number of pistons per engine type, an inlet port and an outlet port. Suitably the pistons on each rotor assembly are disposed equidistant about the outer portion of the respective rotors.

It is further preferred that the engine operate as a four stroke/cycle engine with the rotor assemblies being driven in the reverse direction to the crankshaft at an average rotational speed equal to one third thereof, that each rotor has a rotor body extending into and sealing the inside opening of the toroidal cylinder and four pistons disposed equidistant about the outer portion of the rotor body and that the inlet and outlet port means comprise a pair of diametrically opposed inlet ports and a pair of diametrically opposed outlet ports and that respective inlet and outlet ports are disposed in pairs of ports adjacent one another and adjacent the position of the pistons when disposed beside one another.

In a preferred embodiment the access means is an annular opening about the inside wall portion of the cylinder and the rotors are arranged in side by side relationship and extend into the opening to operatively seal this opening and support their respective pistons in the cylinder. The opening and the rotors may be asymmetrical about a centreplane containing the toroidal centreline of the cylinder but preferably the annular opening and the rotors are symmetrical about the centreplane. The cross-sectional configuration of the toroidal housing is suitably circular but it may be square or triangular or of other form as desired.

Preferably the rotor assemblies are substantially centrally disposed within the cylinder housing assembly and supported rotatably on a central journal of a crankshaft which has in-line crankpins at opposite sides of the central journal for supporting spaced pairs of aligned planetary members and the rotor assemblies support respective drive pins extending from opposite sides of the rotor assembly, through the adjacent rotor assembly, to each planetary member. In the embodiment having four pistons per rotor, identical but opposed rotors may be utilised with the drive pins offset 22.5 degrees from a line extending between opposed pistons. The radial location of the drive pins may also be varied to achieve variations in the relative movements of the pistons of the respective rotor assemblies.

The opening of the inlet and outlet ports could be timed by poppet valves or the like, but preferably, the inlet and outlet ports are formed in the cylinder wall and are timed by their arcuate length providing the selected communication with the working chambers. The ports could be formed in one housing portion, but preferably the inlet ports are formed in one housing portion and the outlet ports are formed in the other housing portion. Suitably the ports exit from opposed side walls of the toroidal cylinder but if desired they could exit at any angle or radially from either one or both cylinder housing assemblies, such as to enable banks of such assemblies to be stacked beside one another to form an engine having multiple toroidal cylinders arranged about a common crankshaft assembly.

It is also preferred that in an engine suitable for low speed high torque applications, such as for powering a commuting vehicle, the engine be formed such that the bore/stroke ratio is in the order of one is to three or one is to four, so that the combustion/expansion process achieves enhanced power extraction and minimises energy wastage. Suitably this is achieved in an engine having a cylinder bore diameter in the range of one quarter to one third the toroidal radius. Suitably the toroidal radius is between six to ten times the throw of the crankpin and the drive pin is offset from the crankshaft axis between three and five times the throw of the crankpin. In a preferred embodiment having four pistons per rotor the drive pins are spaced from the crankshaft axis four times the spacing of the crankpin therefrom and the toroidal axis is spaced from the crankshaft axis eight times the spacing of the crankpin therefrom.

Alternatively, an engine for high speed performance applications having twelve or sixteen pistons for each pair of rotors for example, may be formed with a bore/stroke ratio in the order of one is to one or one is to two.

In another aspect this invention resides broadly in a internal combustion toroidal engine of the type having a toroidal cylinder formed in a cylinder housing assembly about a driveshaft assembly supported for rotation about an axis concentric with the axis of the toroidal cylinder and coupled to axially opposed rotor assemblies supporting pistons in the toroidal cylinder by coupling means whereby rotation of the driveshaft causes the pistons to move cyclically toward and away from one another and vice versa, forming expanding and contracting working chambers therebetween within the toroidal cylinder and inlet and outlet port means extending through the cylinder housing assembly for entry and exit of fluid to and from the working chambers, and wherein:

the driveshaft is constrained for counter-rotation relative to the rotor assemblies whereby the speed of rotation of the rotor assemblies is reduced relative to the speed of rotation of the driveshaft.

In an internal combustion toroidal engine suitable for powering a medium sized car for comfortable highway cruising it is preferred that at 100 kph the average piston speeds be maintained in the order of 1100 fpm, which for an engine having a toroidal centreline radius of between 150 mm and 200 mm results in a rotational speed of the rotor assemblies of about 300 RPM.

This is preferably achieved by configuring the engine whereby the driveshaft rotates three times faster than the rotor assemblies, that is at about 900 RPM. This output shaft speed is accommodated using a final drive ratio of 1:1. For smaller vehicles similar proportions will exist. That is smaller wheel diameters will correlate to smaller toroidal cylinders with rotor assemblies rotating at higher speeds for the same piston speed.

In yet another aspect this invention resides broadly in a internal combustion toroidal engine of the type having a toroidal cylinder formed in a cylinder housing assembly about a driveshaft assembly supported for rotation about an axis concentric with the axis of the toroidal cylinder and coupled to axially opposed rotor assemblies supporting pistons in the toroidal cylinder by coupling means whereby rotation of the driveshaft causes the pistons to move cyclically toward and away from one another and vice versa, forming expanding and contracting working chambers therebetween within the toroidal cylinder and inlet and outlet port means extending through the cylinder housing assembly for entry and exit of fluid to and from the working chambers, and wherein the coupling means coupling the pistons in the toroidal shaped cylinder to the driveshaft includes:

drive means for coupling one rotor assembly to the driveshaft;

a crankpin offset from the driveshaft;

a planetary member driven for rotation about the crankpin at a predetermined rotational speed relative to the driveshaft whereby the planetary member is supported on the crankpin for epicyclic movement about the driveshaft, and the driveshaft is in the form of a crankshaft extending through the cylinder housing assembly and forming the crankpin intermediate its mountings in the cylinder housing assembly and the planetary member is supported on the offset crankpin.

In a further aspect this invention resides broadly in a rotary positive displacement apparatus of the type having a toroidal cylinder formed in a cylinder housing assembly about a driveshaft assembly supported for rotation about an axis concentric with the axis of the toroidal shaped cylinder and coupled to axially opposed rotor assemblies supporting pistons in the toroidal shaped cylinder by coupling means whereby rotation of the driveshaft causes the pistons to move cyclically toward and away from one another and vice versa, forming expanding and contracting working chambers therebetween within the toroidal cylinder and inlet and outlet port means extending through the cylinder housing assembly for entry and exit of fluid to and from the working chambers, and wherein:

the cylinder housing assembly includes respective opposed housing portions which mate along the centreplane of the toroidal cylinder;

the driveshaft assembly extends between the housing portions and is rotatably engageable with the respective opposed housing portions by loading opposite ends of the driveshaft axially into the respective opposed housing portions from the interior thereof, and wherein the coupling means comprises components which may be operatively assembled over the driveshaft from one or respective opposite ends thereof by interengagement of components in an axial direction whereby the rotary positive displacement apparatus may be readily assembled by sequentially adding components in an axial direction into operative engagement with one another.

Preferably the driveshaft is formed as a crankshaft and wherein the coupling means includes a drive yoke rotatable with a planetary gear about a crankpin assembly of the crankshaft with a planetary gear meshed with an internal annulus gear fixed to the adjacent housing portion concentrically with the driveshaft axis. The drive yoke may include a radially extending slot in which a slide block is fitted prior to assembly of the drive yoke onto the driveshaft. In such arrangement the slide block is suitably associated with a drive pin extending in the assembly direction into engagement with a rotor assembly.

Also, to facilitate assembly by loading components in an assembly direction, it is preferred that the drive yoke is driven by a planetary gear fixed to the drive yoke for rotation therewith and meshed with an annulus gear fixed to the housing with its axis coaxial with the driveshaft.

In still a further aspect this invention resides broadly in an internal combustion engine including:

a cylinder housing assembly having a toroidal shaped cylinder and an annular access opening to the cylinder;

a crankshaft assembly supported in the cylinder housing assembly for rotation about a crankshaft axis concentric with the axis of the toroidal shaped cylinder and supporting a crankpin assembly with its axis offset from the crankshaft axis;

a planetary member supported on the crankpin assembly for rotation about the crankpin assembly;

a pair of rotor assemblies, juxtaposed said planetary member and supported for rotation about an axis concentric with the axis of the toroidal shaped cylinder, each rotor assembly including a body portion supporting pistons, the total number of pistons for each pair of rotors being a multiple of four, the pistons being disposed equidistant about the body portions of the respective rotors and sealably engaged with the cylinder and moveable therearound, each body portion extending into the access opening to operatively close the toroidal cylinder;

coupling means coupling the planetary member and the rotor assemblies such that the coupled rotors and planetary member are carried around the crankshaft axis, and whereby rotation of the planetary member about the crankpin causes the rotor assemblies to move out of phase with respect to one another, and the pistons to move cyclically toward and away from one another forming expanding and contracting working chambers therebetween within the toroidal cylinder expanding and contracting between minimum and maximum working chamber volumes;

inlet and outlet port means extending through the cylinder housing assembly for entry and exit of fluid to and from the cylinder, the inlet and outlet port means comprising for each four pistons, an inlet port and an outlet port;

the inlet and outlet ports are disposed at positions at which adjacent pistons form minimum working chamber volumes;

drive means for rotating the planetary member about the crankshaft at a relative rotational speed whereby the inlet port means successively opens in a constant timed relationship to an expanding working chamber and the outlet port means successively opens in a constant timed relationship to a contracting working chamber.

Preferably, the internal combustion engine includes a duplicate planetary member mounted on a further in-line crankpin at the opposite side of the rotor assemblies, and coupling means coupling the duplicate planetary member to the rotor assemblies. It is also preferred that the internal combustion engine has the cylinder housing assembly formed as a split housing, split along the centreplane containing the toroidal centreline of the cylinder to form opposed housing parts, which are spaced apart along an inside portion of the cylinder housing assembly to form the annular access opening, the planetary members supported in spaced apart relationship on respective co-axial crankpins for rotation thereabout, and coupling means which includes respective slide means associated with the planetary members having diametrically opposed slides engaging respective drive pin assemblies which extend parallel to the crankshaft axis and from opposite sides of each rotor assembly to each planetary member.

In order that this invention may be more readily understood and put into practical effect, reference will now be made to the accompanying drawings annotated with reference numbers. The drawings illustrate spark ignition, water cooled, internal combustion petrol engines wherein.

Figure 7:
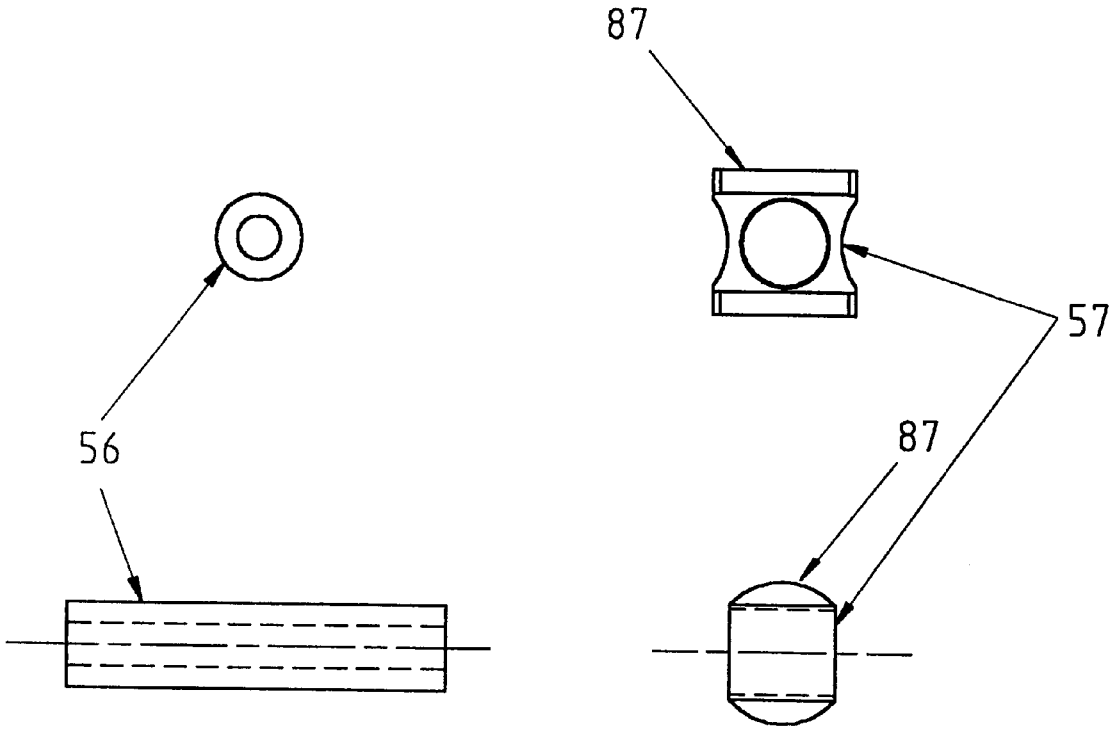
Figure 8:
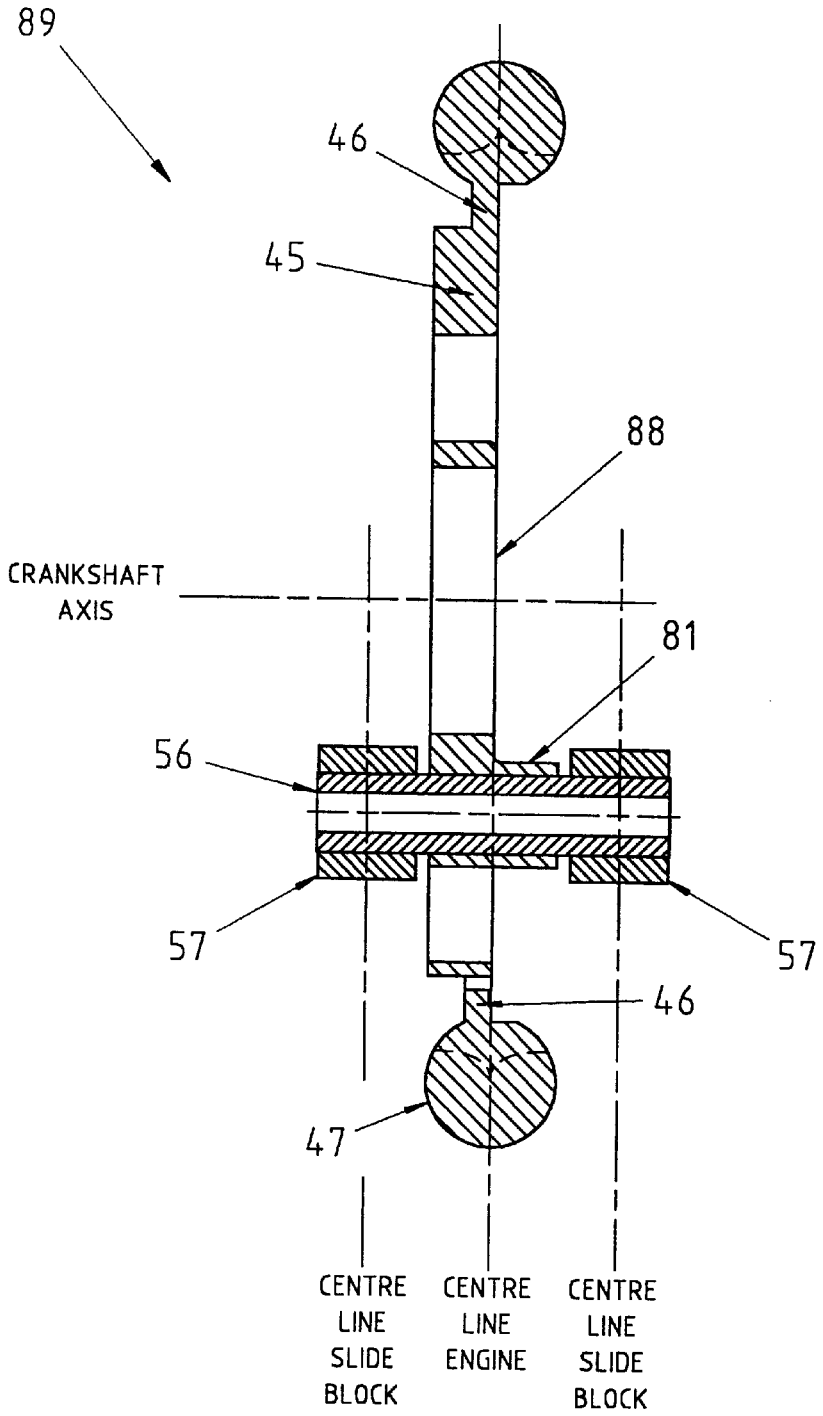
Figure 10:
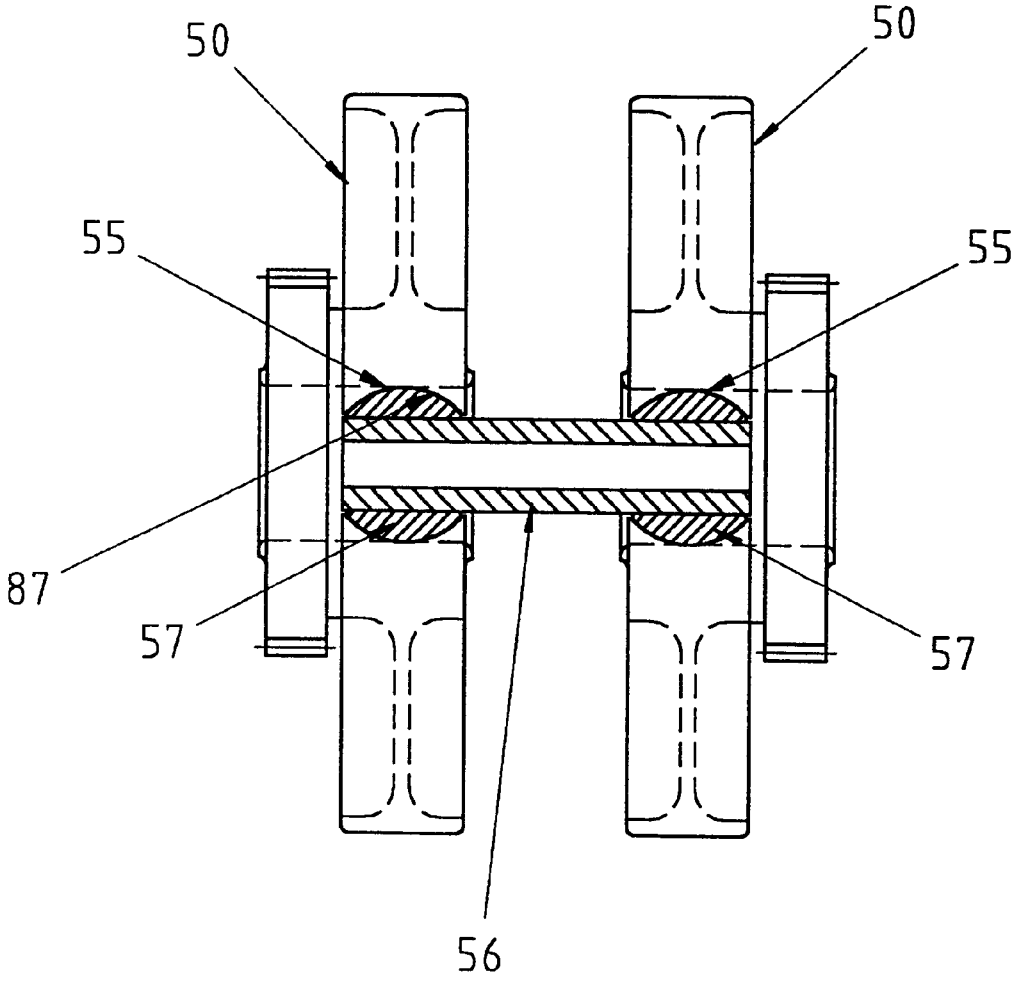
Figure 11:
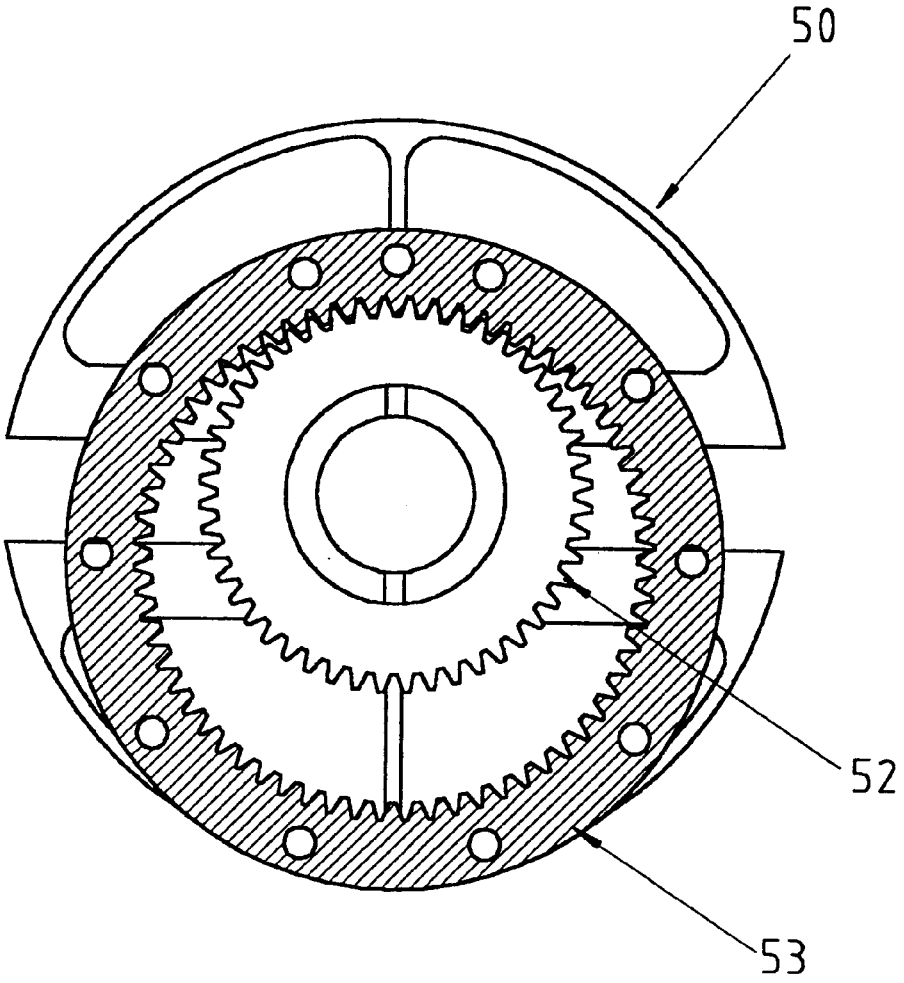
Figure 12:
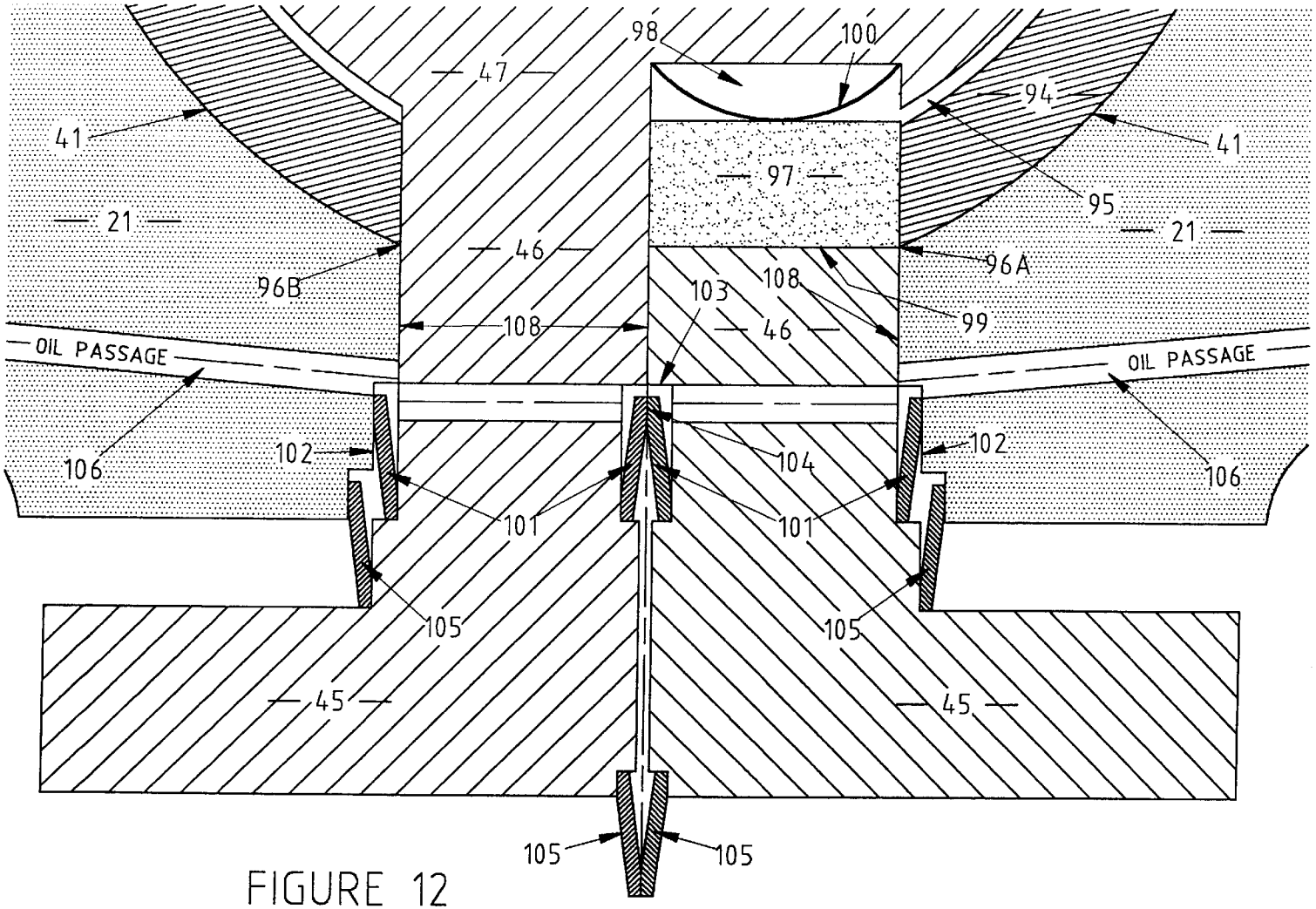
Figure 13:
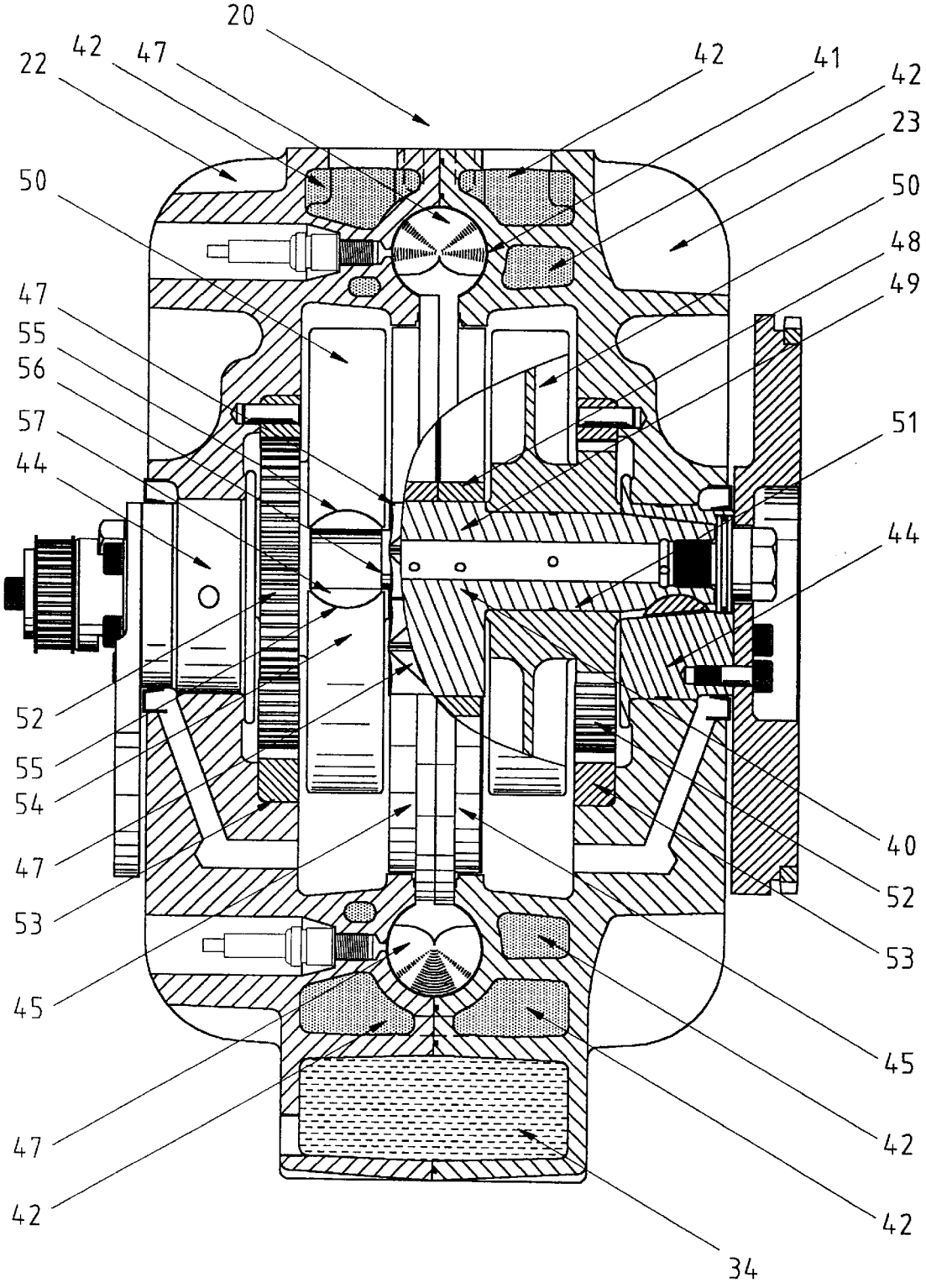
Figure 15:
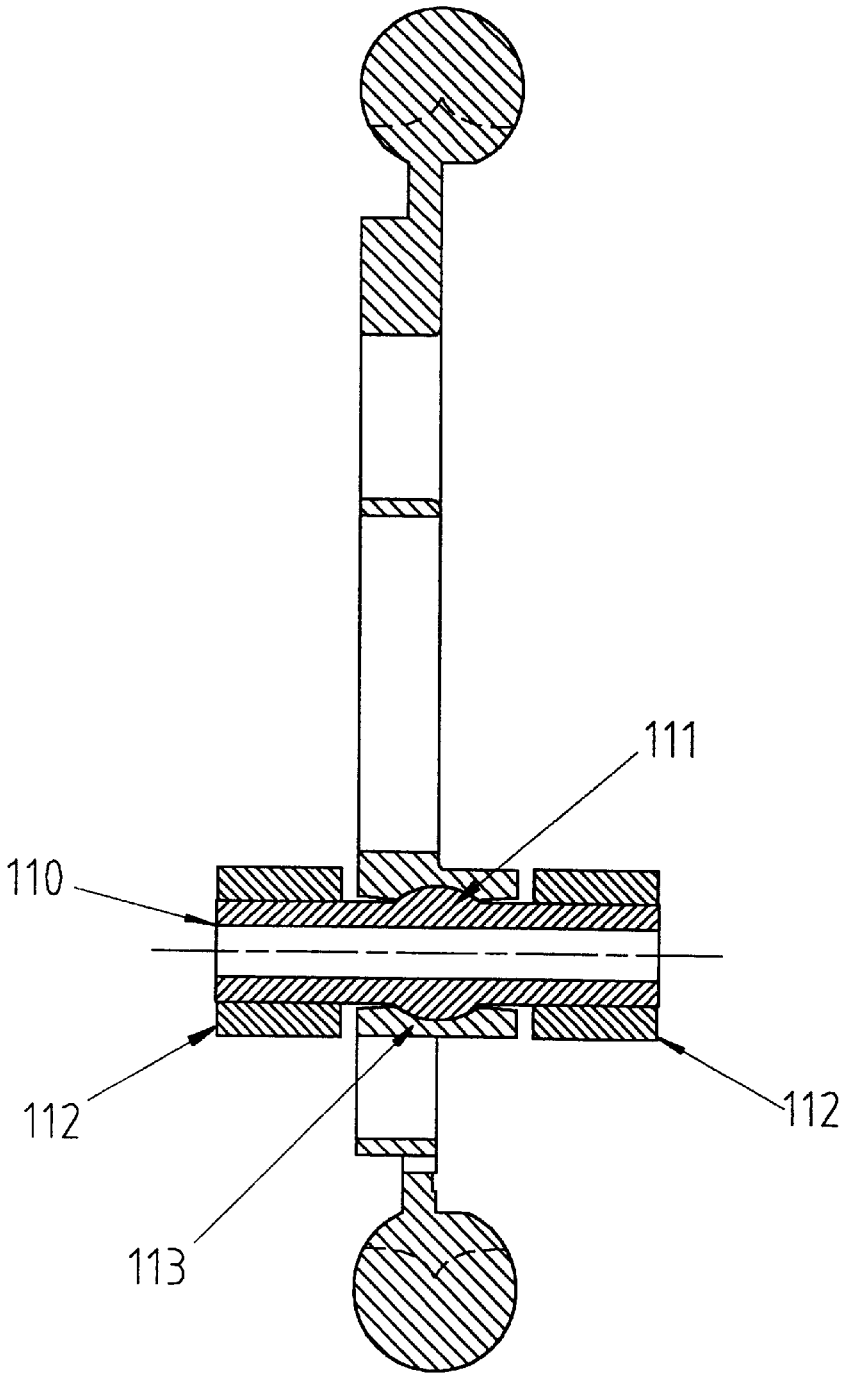
Figure 16:
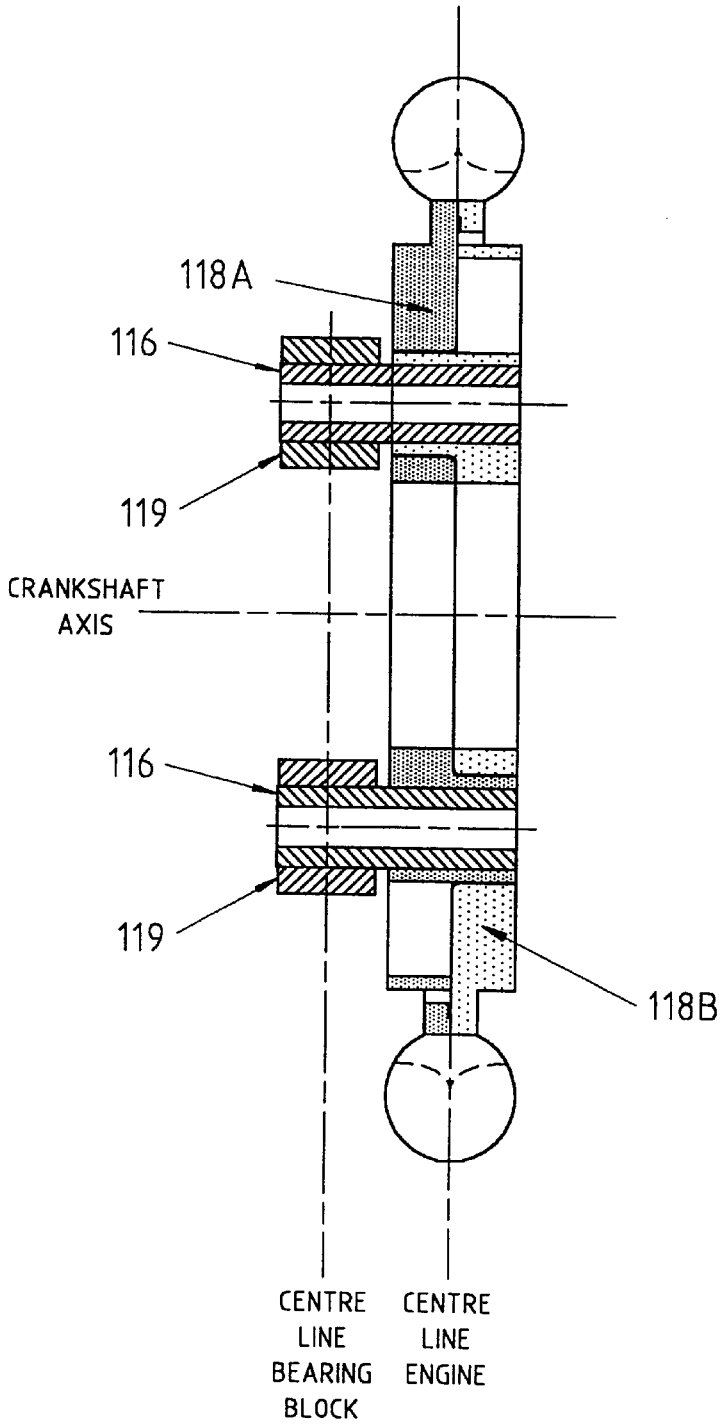
Figure 17:
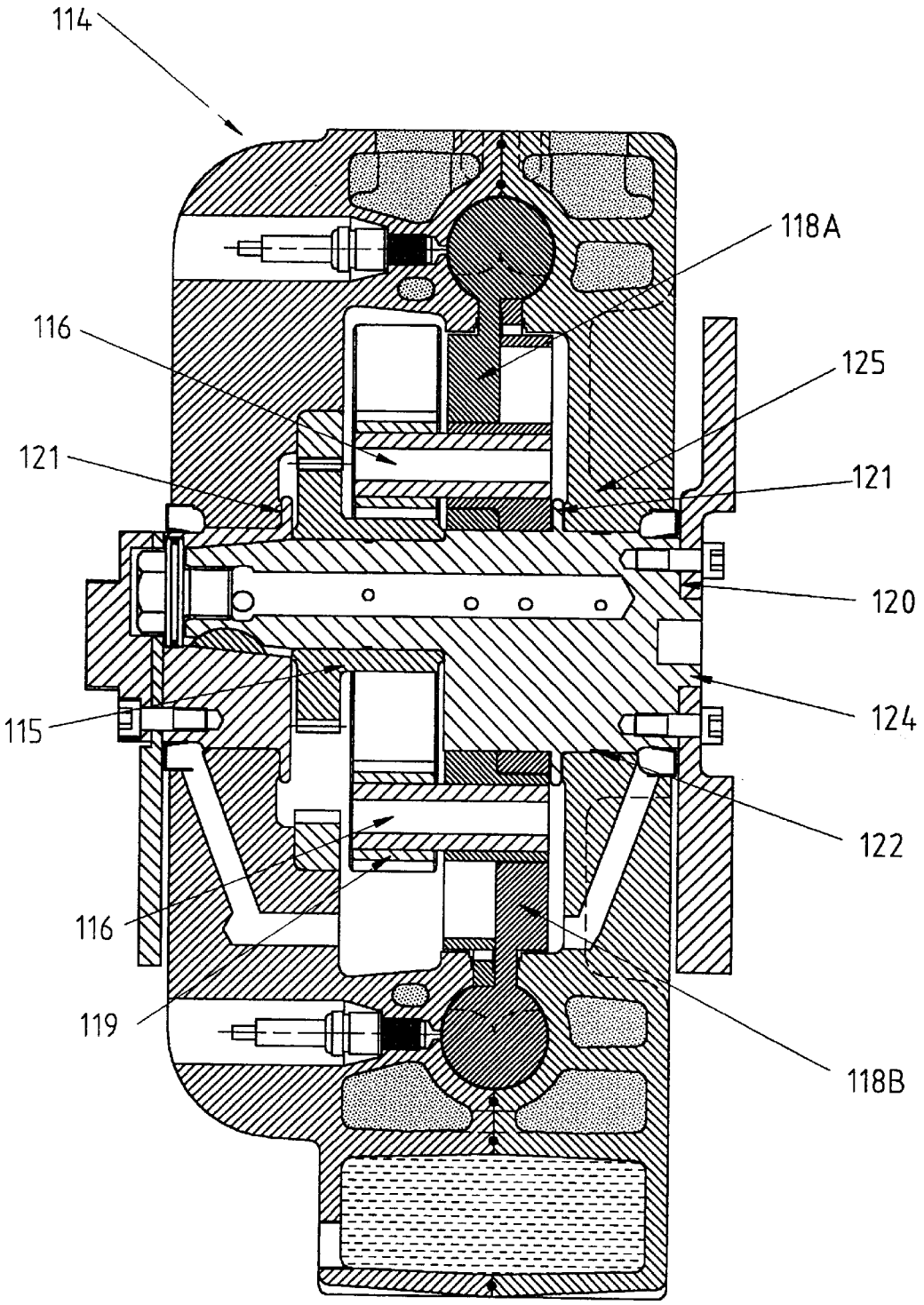
Figure 18:
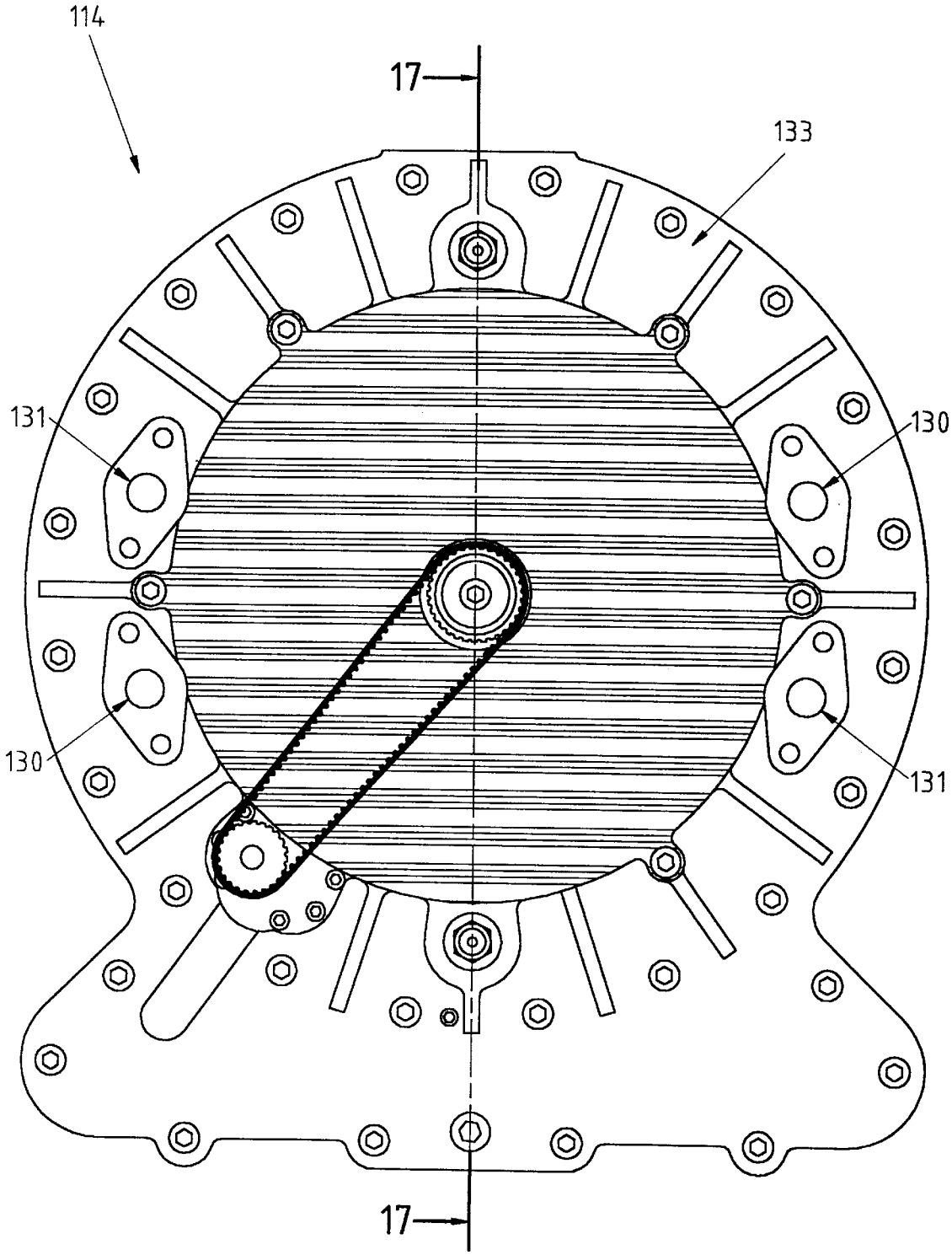
Figure 19:
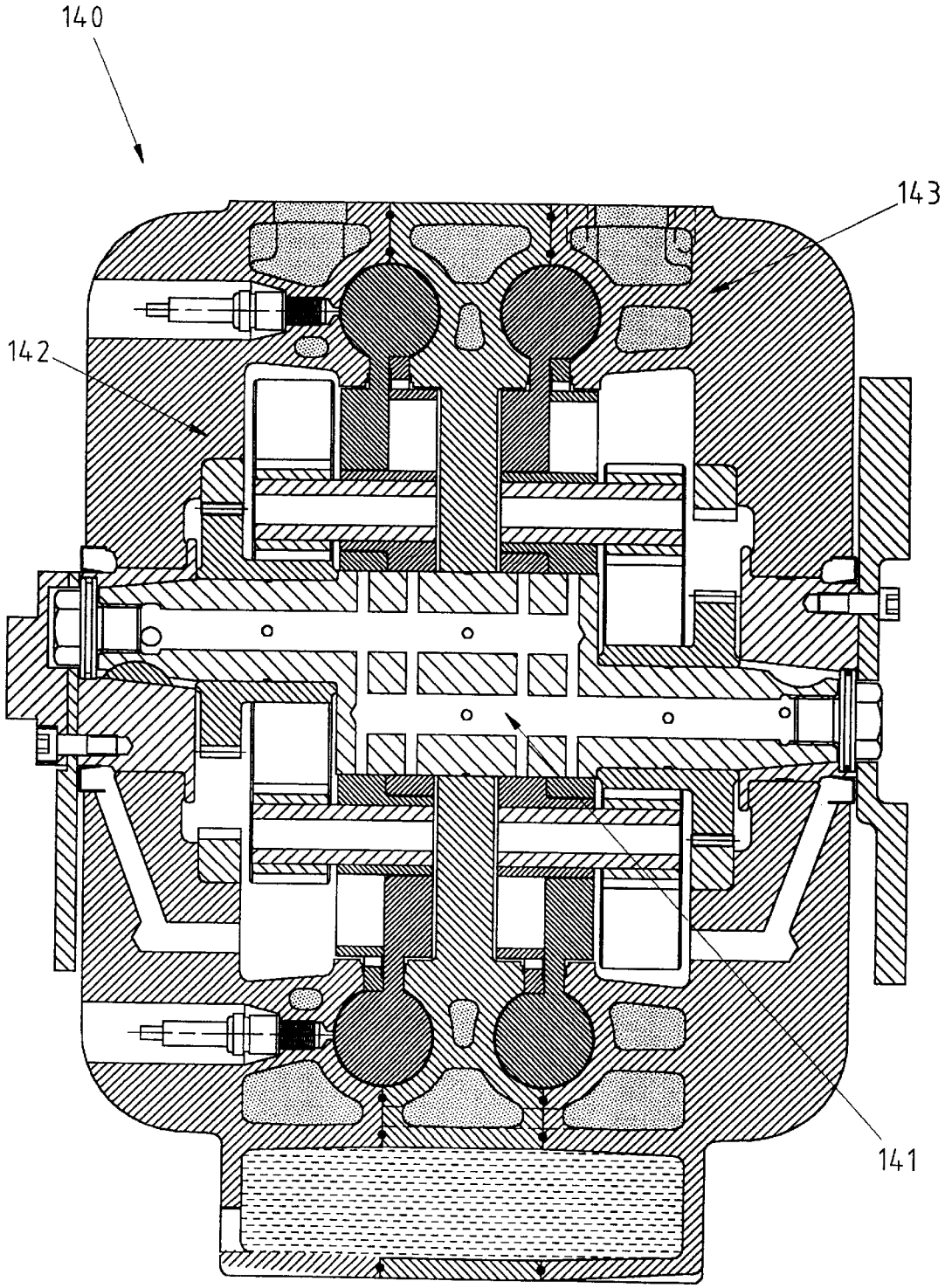

FIG. 7 provides end and side views of the drive pin and bearing blocks;

FIG. 8 is a cross-sectional view of a rotor assembly which includes the drive pin and bearing blocks;

FIG. 9 provides end, top and side views of a planetary member;

FIG. 10 illustrates spaced planetary members supporting a drive pin and bearing blocks;

FIG. 11 illustrates the connection between the planetary member and the annulus gear;

FIG. 12 is an enlarged view showing the sealing arrangements of the rotor assemblies in the cylinder housings;

FIG. 13 is a longitudinal cross-sectional view of the assembled engine components;

FIGS. 14*a*–14*gg* comprise six sheets providing a sequenced illustration of the working chambers of the above engine during one engine cycle;

FIG. 15 illustrates an alternative drive pin that incorporates a spherical bearing and fitted in the rotor assembly;

FIG. 16 illustrates two coupled rotor assemblies for the single planetary member or light industrial engine with associated drive pin and bearing blocks;

FIG. 17 is a cross sectional view of the light industrial or single mechanism engine;

FIG. 18 is a front view of the light industrial or single mechanism engine; and FIG. 19 is a cross sectional view of a twin toroidal cylinder engine with the rear pair of rotors mis-phased in the drawing by 90 degrees for demonstrative purposes.

Figure 20:
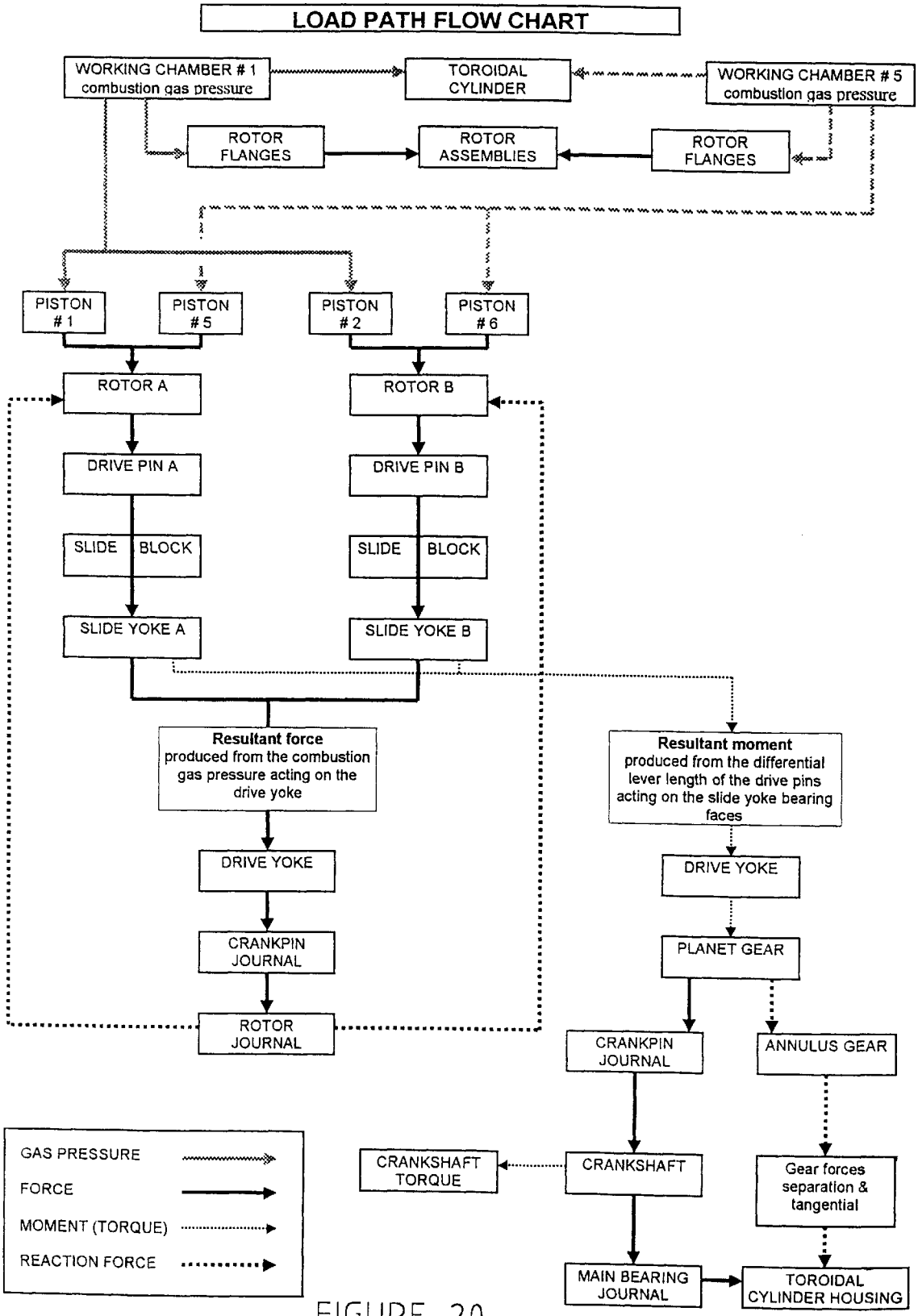

FIG. 20 is a block diagram of a flow chart for the internal engine load paths which result in the output torque at the crankshaft.

Figure 1:
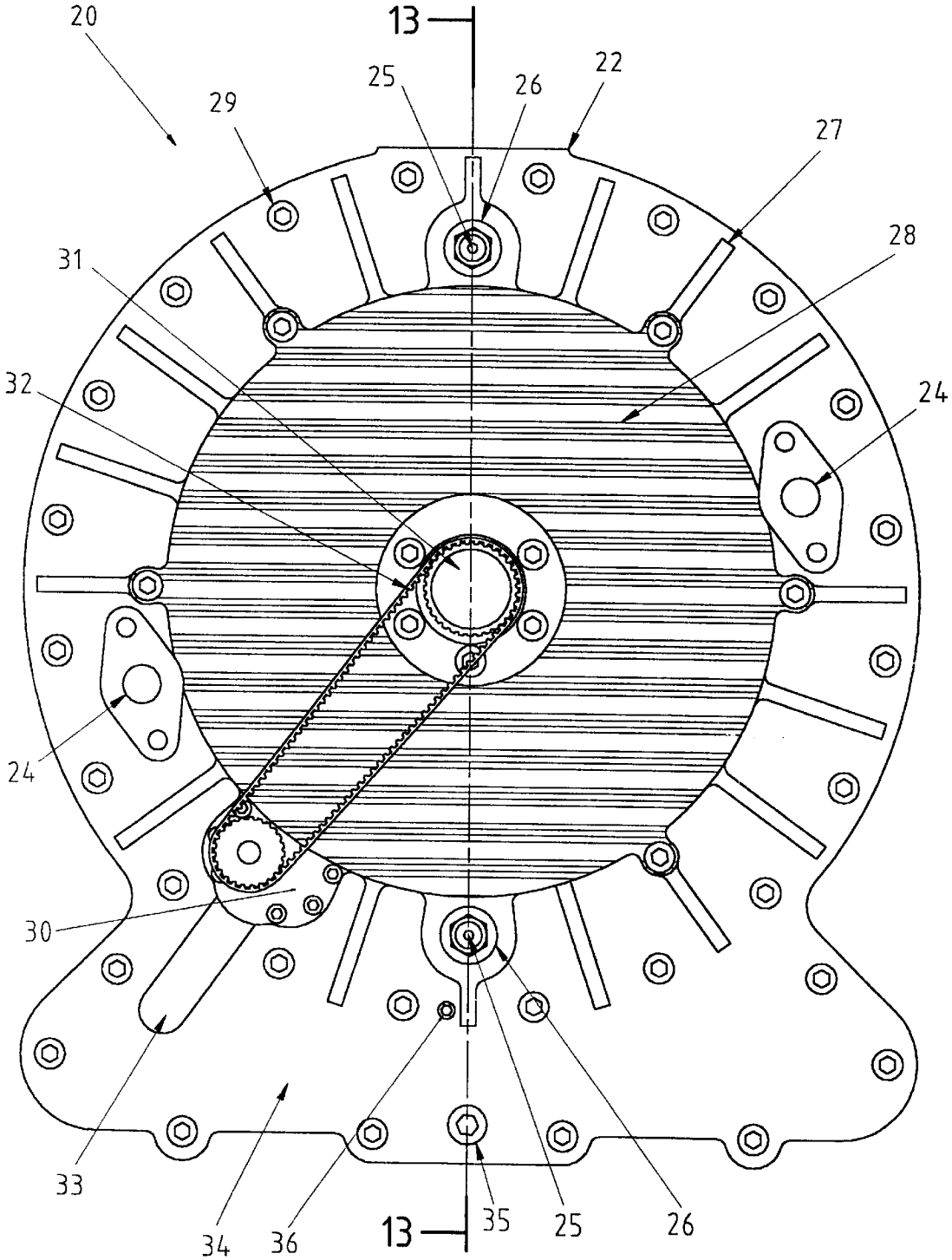
FIGS. 1 and 2 are front and rear end views of the engine, respectively.

As illustrated in FIG. 1, the front cylinder housing portion 22 of the engine 20 has two intake ports 24, two spark plugs 25 mounted in two spark plug locations 26, a series of radial reinforcing ribs 27, and a front crankshaft counterweight cover 28 (hatched). The front cylinder housing portion 22 is bolted to the rear cylinder housing portion 23 (FIG. 2) by a series of peripheral bolts 29. The front cylinder housing portion 22 also has provision for an integral oil pump 30 driven by a crankshaft pulley 31 and a toothed belt 32. The oil pump 30 is supplied by an oil gallery 33 from the sump 34 and the oil in the sump 34 may be drained through the bung 35. A coolant drain bung 36 is situated at the lowest point of the water jacket.

Figure 2:
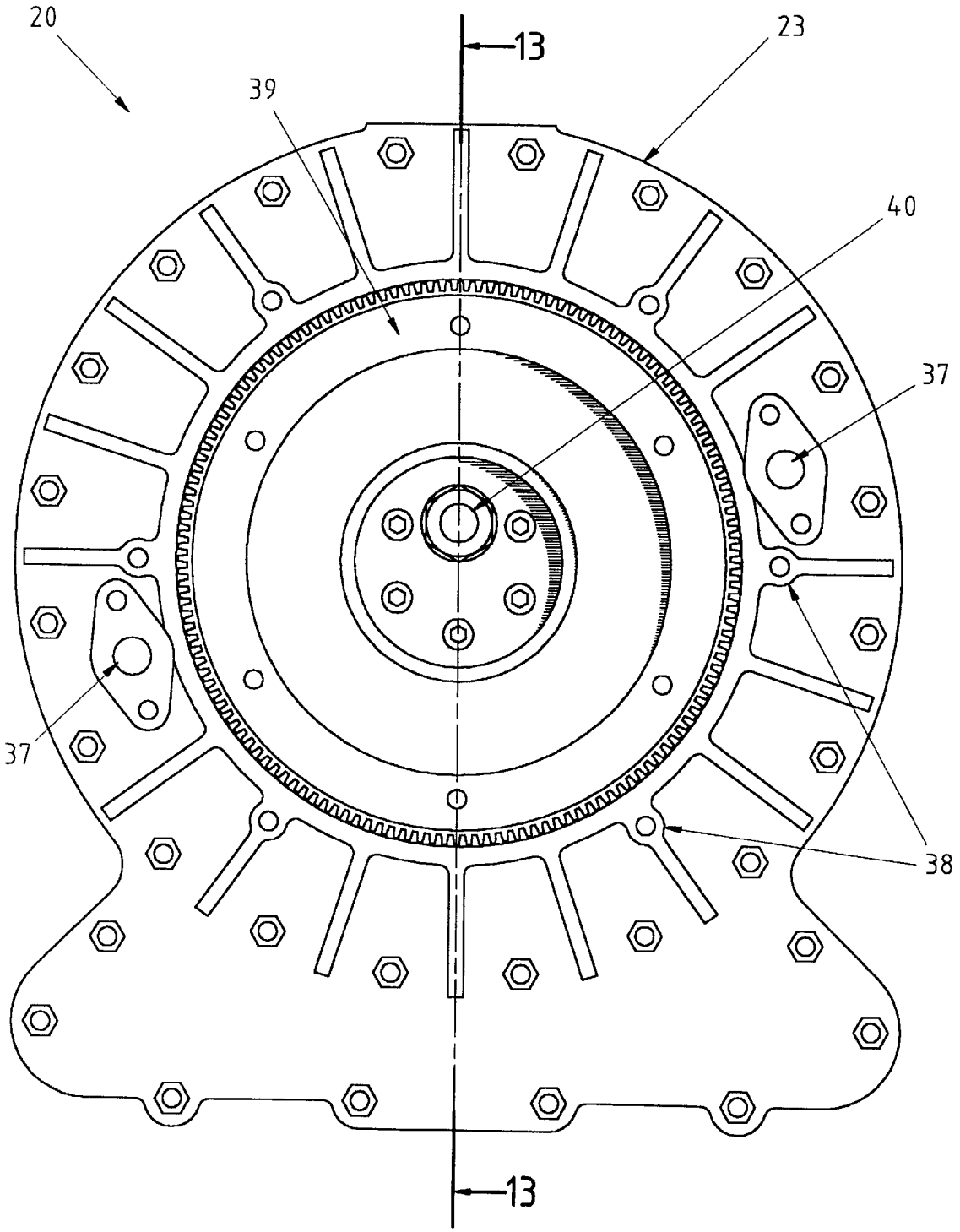

As illustrated in FIG. 2, the rear cylinder housing portion 23 of the engine 20 has two exhaust ports 37 and a bell housing mounting provision 38 to adapt the desired driven members thereto. A flywheel 39 (hatched) is shown bolted to the crankshaft assembly 40.

Figure 3:
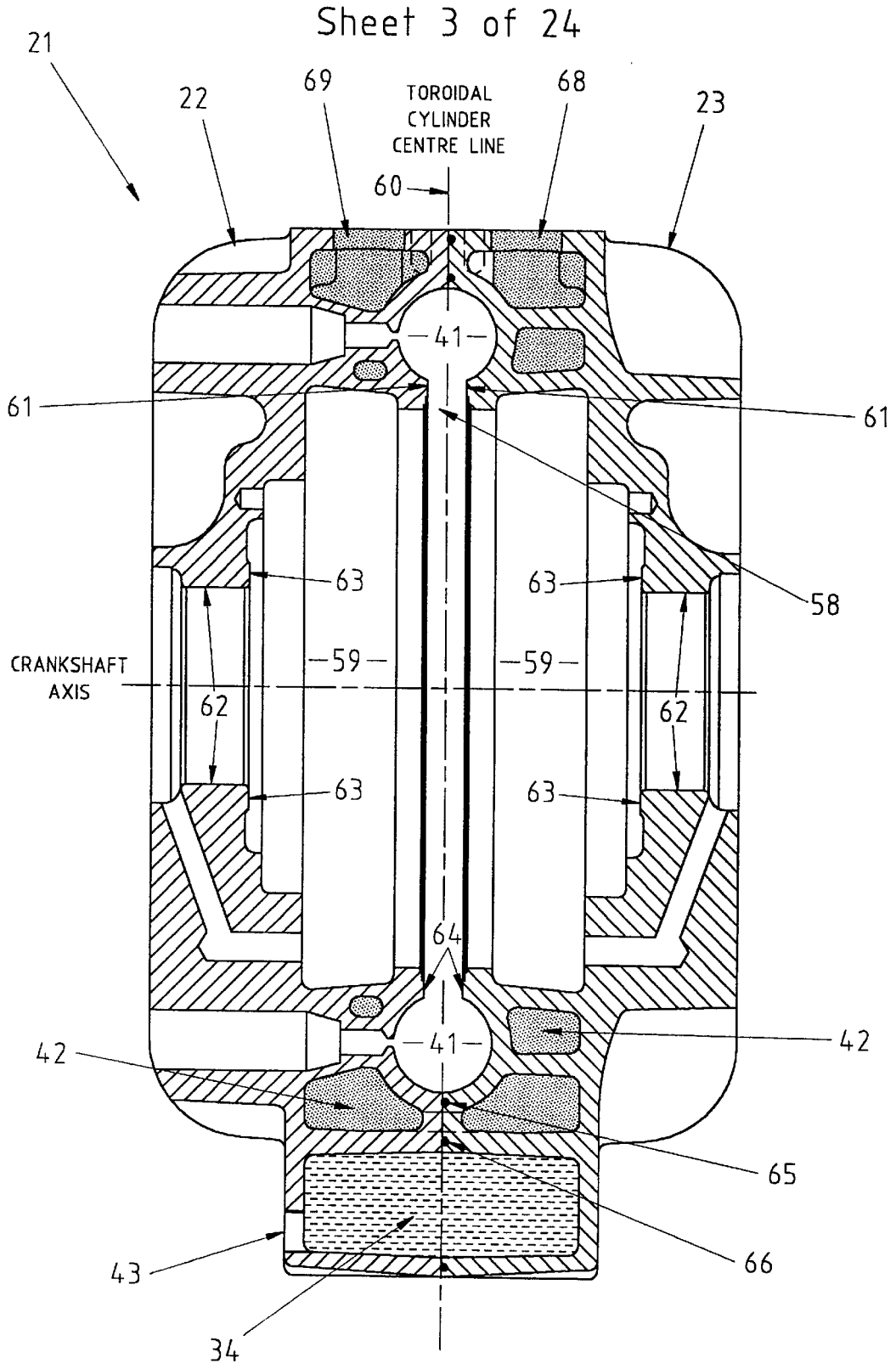
FIG. 3 is a longitudinal cross-sectional view of the cylinder housing assembly.

As illustrated in FIG. 3, the cylinder housing assembly 21 is formed by bolting the opposed housing portions 22 and 23 together. The housing assembly 21 provides a toroidal cylinder 41 and an annular opening 58 about its inner face opening into the interior of housing 59. The annular opening 58 is formed symmetrically about the plane containing the toroidal centreline 60 and between the opposed spaced apart circular faces 61 of the housing portions 22 and 23.

The main bearings 62 and the main bearing internal side-thrust faces 63 are located centrally in the front and rear cylinder housing portions 22 and 23, while the rotor side-thrust faces 64 are located on the sides of the annular opening 58.

A combustion seal 65 and another seal 66 are located between the cylinder housing portions 22 and 23. The seal 65 is situated between the toroidal cylinder 41 and the water jacket 42 to prevent combustion gas leakage and the seal 66 is situated between the water jacket 42 and the exterior of the cylinder housing 21 to prevent coolant leakage to the outside of the engine or at the lower portion of the engine into the sump.

The water inlet 68 is situated at the top of the rear cylinder housing portion 23 while the engine water outlet 69 to the radiator is situated at the top of the front cylinder housing portion 22. Oil in the sump 34 is drained via the oil drain hole 43.

Figure 4:
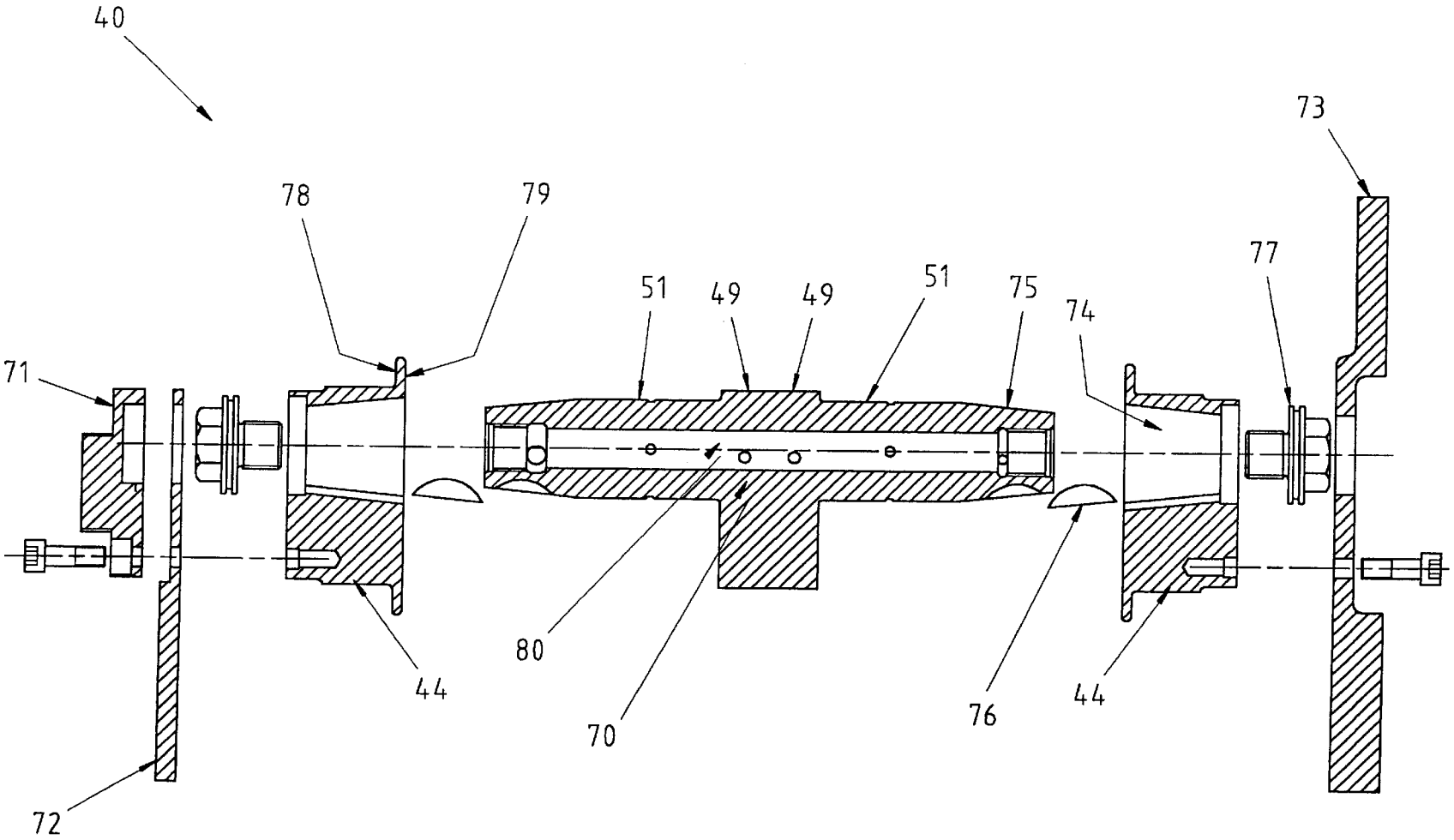
FIG. 4 is an exploded view of the crankshaft assembly.

As illustrated in FIG. 4, the crankshaft assembly 40 is a multi-piece unit comprising a crankshaft 70 with two crank-pin journals 51, two central rotor journals 49, and two removable main bearing journals 44. The crankshaft assembly 40 incorporates the front pulley 71, the front counter-weight 72 and the counterweighted flywheel 73. Each main bearing journal 44 has an offset tapered hole 74 which locates it on to a corresponding tapered spigot 75 at the end of the crankpin 51. The main bearing journal 44 is aligned by a key 76, then fastened by a retaining bolt 77 to the tapered spigot 75. The main bearing journals 44 also incorporate thrust faces 78 to control the end float of the crank-shaft assembly 40 in the cylinder housing assembly 21 and thrust faces 79 to control the end float of the planetary member 50 (see FIG. 9). The crankshaft assembly 40 located in the cylinder housing assembly 21 is supported in the main bearings 62 (see FIG. 3). Oil supply to the bearings is via a central main gallery 80 in the crankshaft 70 and cross-drilled to the journals 44, 49 and 51.

Figure 5:
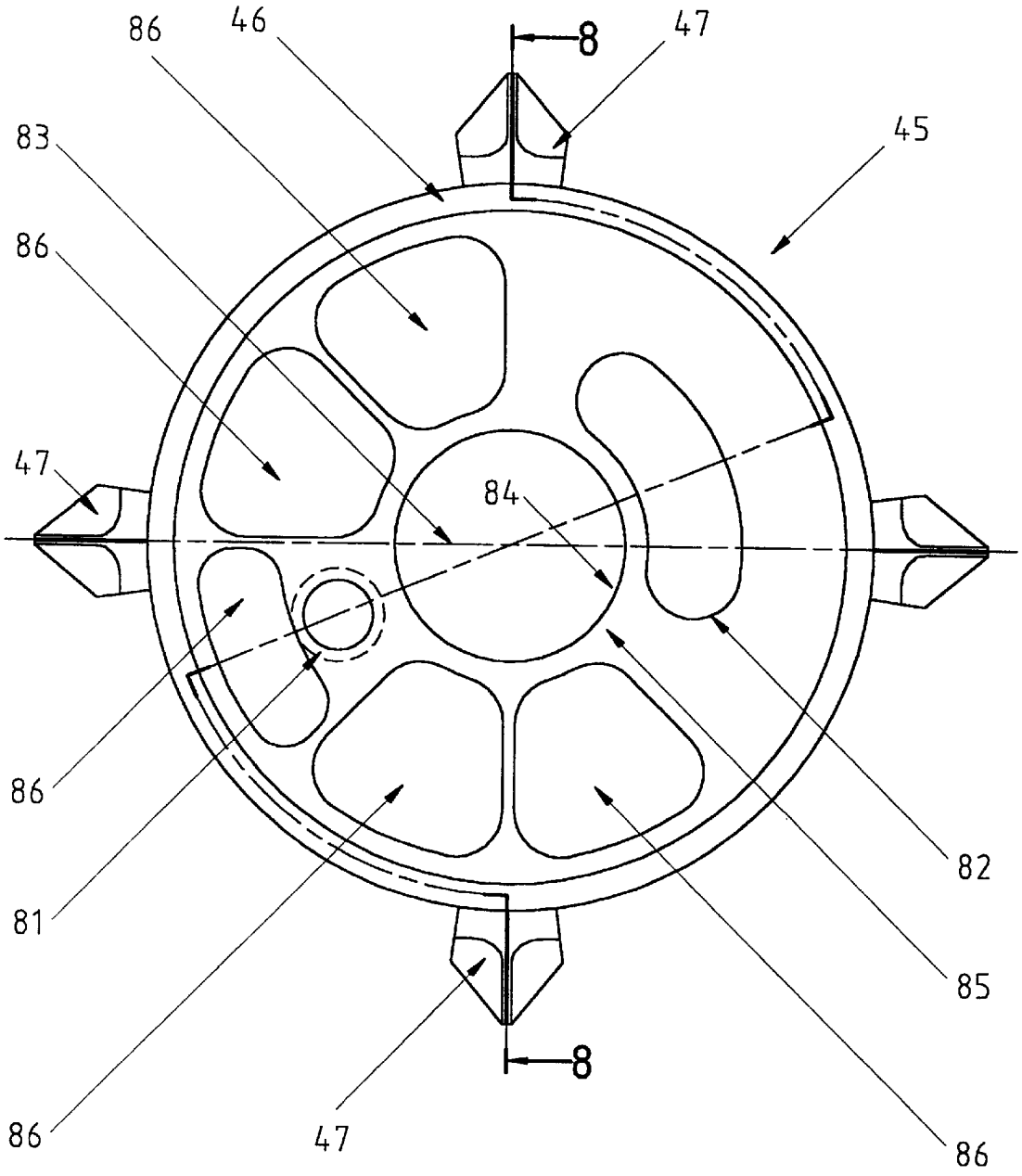
FIG. 5 is an end view of a rotor with pistons.

As illustrated in FIG. 5, each rotor assembly 45 has four pistons 47 which are symmetrical fore and aft and are supported at their base by the outer flange 46. Each rotor 45 contains a drive pin boss 81 spaced inwardly from the outer flange 46, and has an arcuate cutout 82 formed diametrically opposite the boss 81. The drive pin boss 81 is offset 22.5 degrees from the common diametrical line 83 of an opposed piston pair, to enable the pistons of mated rotor assemblies to nest in series around the toroidal cylinder 41 (see FIG. 3) and oscillate to and from one another on the bearing surface 84 of the bearing hub 85. The mass of the rotor assembly 45 is minimised by a series of windows 86.

Figure 6:
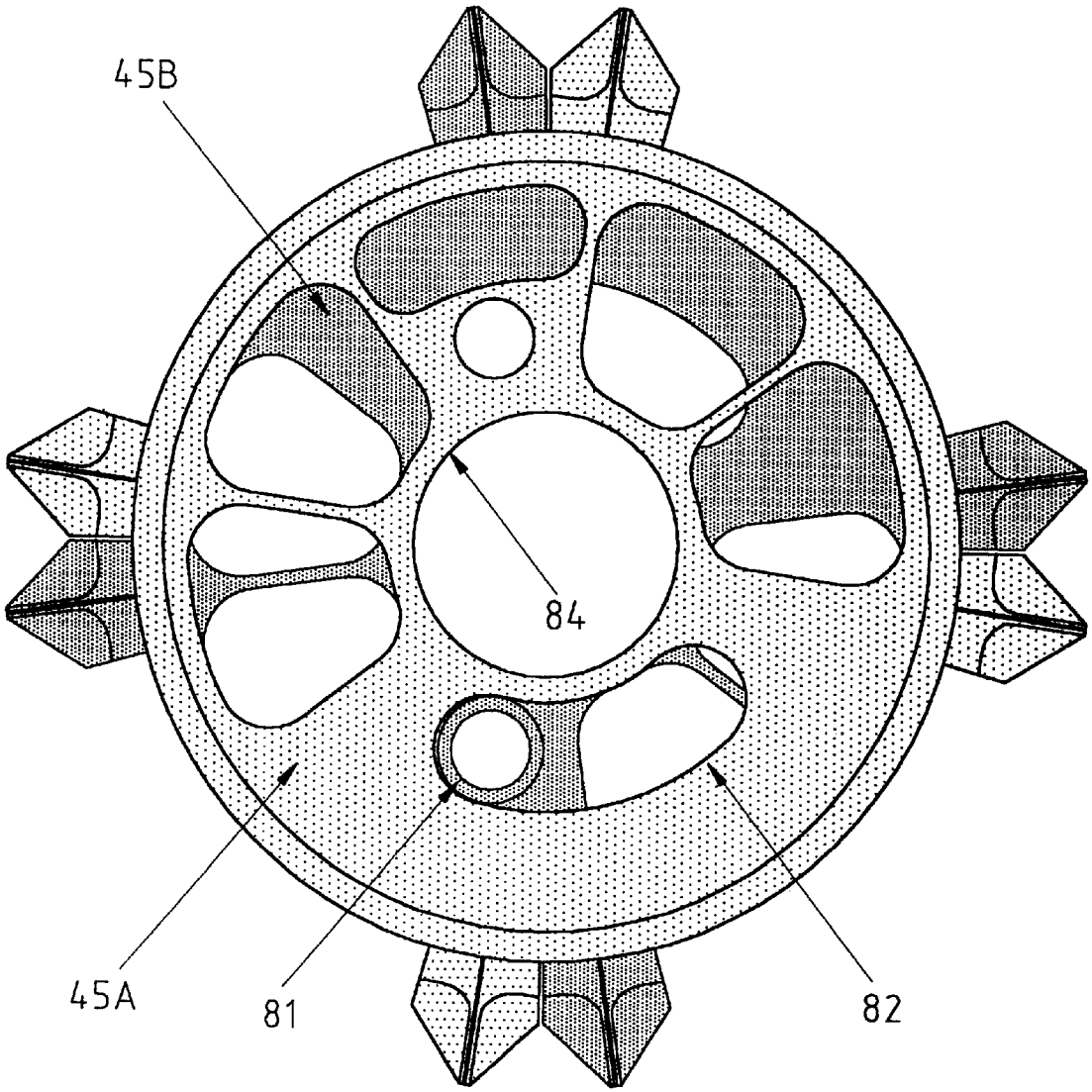
FIG. 6 illustrates an end view of the opposed rotors with pistons in an operative relationship and illustrated with the rotors differentially cross-hatched for clarity.

As illustrated in FIG. 6, the arcuate cutout 82 in rotor 45A accommodates the boss 81 of the corresponding opposed rotor 45B when mated thereto as illustrated. This cutout 82 enables the mated rotors 45, differentially cross-hatched for clarity, to oscillate relative to one another within the limits of the cutouts 82.

As illustrated in FIG. 7, each drive pin 56 supports a bearing block 57 at its opposite ends and each bearing block 57 has a part-cylindrical outer bearing surface 87.

As illustrated in FIG. 8, the pistons 47 are mounted on the outer flange 46 of the rotor assembly 45, with their centres in a plane containing the inner face 88 of each rotor assembly 45 whereby they extend beyond the inner face 88. A respective drive pin 56 extends through the boss 81 of the rotor assembly 45 and supports a bearing block 57 at each of its ends. The drive pin 56 and bearing blocks 57 combining with the rotor assembly 45 to become the operative rotor assembly 89.

As illustrated in FIG. 9, the planetary member 50 is formed with diametrically opposed sliding yokes 54 each having opposed part-cylindrical slide surfaces 55 supported by part-circular flanges 90 extending about the bearing hub 91. The slide surfaces 55 extend outwardly from adjacent the hub 91 and terminate at the spaced open ends 92 of the yokes 54. The planetary member 50, incorporates a planet gear 52 on its outer end and has thrust faces 93 at either end of the bearing hub 91.

FIG. 10, illustrates the drive pin 56 coupling the planetary members 50 through the bearing blocks 57 slidable in the bearing faces 55 of the respective planetary members 50. The part cylindrical bearing faces 87 of the bearing blocks allows for axial deflection of the drive pin during operation.

FIG. 11 illustrates the gear drive means for rotating the planetary member 50 about its orbiting axis, through the planet gear 52 to the annulus gear 53. It will be seen that the orbiting axis is the centre line of the crankpin about which the planetary member 50 is freely rotatable.

In FIG. 12, the rotor assembly sealing arrangement is illustrated. The pistons 47 are sealed in the toroidal cylinder 41 by conventional type piston rings 94 which extend in ring grooves 95 about the respective pistons 47 from the outer flanges 96A and 96B of the rotors 45. One end portion of each piston ring 94 abuts a slide seal 97.

Preferably, the slide seal 97 is cylindrical with its contact surface being arcuate in form corresponding to the radius of curvature of the rotor's outer surface and is biased into wiping engagement with the exposed edge 99 of the adjacent rotor 45 by a spring 100.

Alternatively, piston ring 94 is shaped to form the slide seal 97, which is carried in an extension 98 of the piston ring groove 95 and is biased into wiping engagement with the exposed edge 99 of the adjacent rotor 45.

If desired the piston rings 94 may fully encircle the pistons 47 through tunnels extending through the rotors at their connections to the pistons 47, with the rings extending across the exposed edges 99 which would be curved as a continuation of the toroidal cylinder 41.

Combustion seals in the form of frusto-conical ring seals 101 extend resiliently between the outer faces 96A and 96B and adjacent recessed faces 102 in the cylinder housing 21 and between the rotors 45 themselves as shown at 103 wherein the flattened base portions 104 of the ring seals 101 wipe against one another. Alternatively, combustion seals in the form of rings may be located in grooves, concentric or eccentric to the axis of the crankshaft in the cylinder housing assembly 21 and may be constrained from rotating by tabs.

For sealing purposes both the contacting side portions of the seals are predominately flat, as illustrated, to effect axial sealing against the respective housing/rotor surfaces. Similar sets of ring seals are located inwardly of the abovementioned combustion seals and form oil seals 105 as illustrated. The oil seals may incorporate O-rings to facilitate sealing.

The combustion seals 101 are supplied with a regulated oil supply through galleries 106 whereby oil is supplied to the seals 101 and to the rotor thrust faces 108. Alternatively, oil may be provided through oil injection.

FIG. 13 illustrates the assembled engine 20 in cross-section. The engine 20 comprises two opposed cylinder housing portions 22 and 23 forming the toroidal cylinder 41 which is partly surrounded by the water jacket 42. The lower portion of the cylinder housing 21 is used as a sump 34.

The engine 20 contains a crankshaft assembly 40 supported on its main bearing journals 44. Two identical but opposed rotor assemblies 45 are supported centrally between the cylinder housing portions 22 and 23 by a respective bearing hub 48 on a central journal 49 of the crankshaft assembly 40.

Two identical but opposed planetary members 50 are supported rotatably on the respective crankpins 51 of the crankshaft assembly 40. Each planetary member has a planet gear 52 incorporated on its outer side which meshes with a respective one of the annulus gears 53 located in a recess in each housing portion 22 and 23 concentric to the crankshaft axis.

A slide yoke 54, formed integrally on the inner side of the planetary member 50, having diametrically opposite slides 55, engages with the respective drive pins 56 through their respective bearing blocks 57. The drive pins 56 are mounted in the respective rotors 45 opposed to each other.

The components are assembled as illustrated such that the action of forcing an adjacent pair of pistons 47 away from one another, such as by a combustion process, will induce rotation of the planetary member 50 and consequent geared travel of the planetary member 50 around the annulus gear 53. The resultant orbiting motion of the planetary members 50 supported on the crankpins 51 causes rotation of the crankshaft assembly 40.

FIGS. 14*a*–14*gg* comprise six sheets and illustrates a complete engine cycle in steps of 33.75 degrees of crankshaft rotation. In the illustrated eight piston engine with four pistons per rotor, a complete engine cycle, corresponding to all engine components starting and returning to their starting position, requires one revolution of the rotors, three revolutions of the crankshaft and achieves sixteen operative combustion and expansion processes. The pistons on rotor A are designated "A1" to "A4" and the pistons on rotor B are designated "B1" to "B4".

During the first one hundred and thirty-five degrees rotation of the crankshaft, the respective opposed pairs of pistons of the set of four pistons A1 to A4 on one rotor will become active pistons and will simultaneously advance through the respective opposed induction/compression zones in the toroidal chamber.

At 67.5 degrees crankshaft rotation, corresponding to one-half stroke of the pistons, the trailing faces of one pair of opposed active pistons A1 and A3 will be inducing combustible mixture into the expanding working chambers therebehind, expanding away from the opposed intake ports, and the leading faces of that pair of opposed active pistons A1 and A3 will compress any previously induced combustible mixture in the contracting working chambers, contracting toward the ignition point.

Simultaneously, the trailing faces of the other pair of opposed active pistons A2 and A4 will be forced by expanding combustion gases to drive the pistons A2 and A4 forming working chambers expanding toward the exhaust ports, providing the engine power, and the leading faces of that pair of opposed pistons A2 and A4 will form contracting working chambers, contracting toward the exhaust ports to force the remaining combustion gases of the previously expanded combustion mixture in the contracting working chamber through the exhaust ports.

During this one hundred and thirty-five degrees rotation of the crankshaft, both the leading and trailing faces of the pistons B1 to B4 will act as reactive faces for the working chambers in the manner of the cylinder closure faces of cylinder heads of a conventional reciprocating engine.

During the next stage, corresponding to rotation of the crankshaft from one hundred and thirty-five degrees to two hundred and seventy degrees, the functions of the respective piston sets are reversed and respective opposed pairs of pistons of the set of four pistons B1 to B4, on rotor B will become the active pistons and will simultaneously perform the functions described above for the pistons A1 to A4, which will become the reactive pistons for the working chambers.

Table 1 details the mode of the working chambers defined between the sixteen working faces of the pistons relative to the rotation of the crankshaft. This tabulation also shows the relative rotation of the rotors as well as their corresponding angular velocities for the cycle positions tabulated.

FIG. 15 illustrates the alternate form of drive pin 110 having a central part spherical bearing 111 housed in a split bushings 113 so that slight variations in alignment between the bearing blocks 112 in the respective drive yokes (not illustrated) may be accommodated without creating imbalances in the forces applied to the drive pin 110. As illustrated the bearing blocks 112 may be adapted for sliding in straight sided slots or they may be part spherical blocks as per the earlier described embodiment.

FIG. 16 illustrates two coupled rotor assemblies of the single planetary member or light industrial engine. The drive pins 116 are cantilevered from the rotor assemblies 118A and 118B for engagement in the bearing blocks 119.

FIG. 17 illustrates the light industrial engine 114 differing from the earlier described engine in that it utilises only a single planetary member 115 with drive pins 116 cantilevered from the rotor assemblies 118A and 118B for engagement in the bearing blocks 119. Such engines are typically provided with a heavy duty output drive coupling 120 to cope with the significant shock loads which may occur at this coupling 120. Thus in this engine the crankshaft is relatively massive at its coupling end 120, extending beyond the main bearing 122 and formed with a locating collar 124 for the purpose of spigotting auxiliary drives or discs. The crankshaft thrusts 121 control the end float of the crankshaft assembly.

FIG. 18 illustrates both the inlet ports 130 and the outlet ports 131 pass through the front cylinder housing 133. In most other respects the industrial engine 114 is similar to the engine illustrated in FIGS. 1 to 13.

In FIG. 19, the engine 140 illustrated is a twin toroidal cylinder engine comprising two banks of single toroidal cylinder engines substantially as illustrated in FIGS. 17 and 18. However, the crankshaft 141 has the respective crankpins offset by 180 degrees. In this embodiment both cylinder end housings 142 and 143 are formed with inlet and outlet ports to the respective cylinders, as per the industrial engine of FIG. 18. The ports in the rear cylinder housing have been rotated 90 degrees about the crankshaft axis relative to the front housing, to form a more even pulse train for minimising the peak/trough power delivery differences.

sixteen combustion and exhaust cycles occurring in distinct hot zones in the toroidal cylinder.

The respective ones of the four cycles are carried out simultaneously in diametrically opposed chambers. That is, the operations on one side of the engine are duplicated on the other side of the engine. This design provides a balance of pressure forces within the eight working chambers of the engine.

TABLE 1

A-16 Engine Simulation

| MEMBER ROTATION | | | | | | | | | | | |
|---|---|---|---|---|---|---|---|---|---|---|---|
| CRANK- | | WORKING CHAMBER DESIGNATE (with bounding laces) | | | | | | | | | |
| SHAFT | YOKE | 1 | 2 | 3 | 4 | 5 | 6 | 7 | 8 | ANGULAR VELOCITY | |
| (degrees) | (degrees) | A1:B1 | B1:A2 | A2:B2 | B2:A3 | A3:B3 | B3:A4 | A4:B4 | B4:A1 | ROTOR A | ROTOR B |
| 0 | 0 | EXH/IND | EXH | IGN | IND | EXH/IND | EXH | IGN | IND | HALF (acc) | HALF (dec) |
| 33.75 | −11.25 | IND | EXH | EXP | COMP | IND | EXH | EXP | COMP | | |
| 67.5 | −22.5 | IND | EXH | EXP | COMP | IND | EXH | EXP | COMP | MAX | MIN |
| 101.25 | −33.75 | IND | EXH | EXP | COMP | IND | EXH | EXP | COMP | | |
| 135 | −45 | IND | EXH/IND | EXH | IGN | IND | EXH/IND | EXH | IGN | HALF (dec) | HALF (acc) |
| 168.75 | −56.25 | COMP | IND | EXH | EXP | COMP | IND | EXH | EXP | | |
| 202.5 | −67.5 | COMP | IND | EXH | EXP | COMP | IND | EXH | EXP | MIN | MAX |
| 236.25 | −78.75 | COMP | IND | EXH | EXP | COMP | IND | EXH | EXP | | |
| 270 | −90 | IGN | IND | EXH/IND | EXH | IGN | IND | EXH/IND | EXH | HALF (acc) | HALF (dec) |
| 303.75 | −101.25 | EXP | COMP | IND | EXH | EXP | COMP | IND | EXH | | |
| 337.5 | −112.5 | EXP | COMP | IND | EXH | EXP | COMP | IND | EXH | MAX | MIN |
| 371.25 | −123.75 | EXP | COMP | IND | EXH | EXP | COMP | IND | EXH | | |
| 405 | −135 | EXH | IGN | IND | EXH/IND | EXH | IGN | IND | EXH/IND | HALF (dec) | HALF (acc) |
| 438.75 | −146.25 | EXH | EXP | COMP | IND | EXH | EXP | COMP | IND | | |
| 472.5 | −157.5 | EXH | EXP | COMP | IND | EXH | EXP | COMP | IND | MIN | MAX |
| 506.25 | −168.75 | EXH | EXP | COMP | IND | EXH | EXP | COMP | IND | | |
| 540 | −18043 | EXH/IND | EXH | IGN | IND | EXH/IND | EXH | IGN | IND | HALF (acc) | HALF (dec) |
| 573.75 | −191.25 | IND | EXH | EXP | COMP | IND | EXH | EXP | COMP | | |
| 607.5 | −202.5 | IND | EXH | EXP | COMP | IND | EXH | EXP | COMP | MAX | MIN |
| 641.25 | −213.75 | IND | EXH | EXP | COMP | IND | EXH | EXP | COMP | | |
| 675 | −225 | IND | EXH/IND | EXH | IGN | IND | EXH/IND | EXH | IGN | HALF (dec) | HALF (acc) |
| 708.75 | −236.25 | COMP | IND | EXH | EXP | COMP | IND | EXH | EXP | | |
| 742.5 | −247.5 | COMP | IND | EXH | EXP | COMP | IND | EXH | EXP | MIN | MAX |
| 776.25 | −258.75 | COMP | IND | EXH | EXP | COMP | IND | EXH | EXP | | |
| 810 | −270 | IGN | IND | EXH/IND | EXH | IGN | IND | EXH/IND | EXH | HALF (acc) | HALF (dec) |
| 843.75 | −281.25 | EXP | COMP | IND | EXH | EXP | COMP | IND | EXH | | |
| 877.5 | −292.5 | EXP | COMP | IND | EXH | EXP | COMP | IND | EXH | MAX | MIN |
| 911.25 | −303.75 | EXP | COMP | IND | EXH | EXP | COMP | IND | EXH | | |
| 945 | −315 | EXH | IGN | IND | EXH/IND | EXH | IGN | IND | EXH/IND | HALF (dec) | HALF (acc) |
| 978.75 | −326.25 | EXH | EXP | COMP | IND | EXH | EXP | COMP | IND | | |
| 1012.5 | −337.5 | EXH | EXP | COMP | IND | EXH | EXP | COMP | IND | MIN | MAX |
| 1046.25 | −348.75 | EXH | EXP | COMP | IND | EXH | EXP | COMP | IND | | |
| 1080 | −360 | EXH/IND | EXH | IGN | IND | EXH/IND | EXH | IGN | IND | HALF (acc) | HALF (dec) |
| (3 revs) | (1 rev) | | | | | | | | | | |

From the above it will be seen that the engine described herein, is a spark ignition water cooled version, that works on a four cycle principle of induction, compression, expansion and exhaust. Each of the eight working chambers, extending between the sixteen working faces, formed by the eight pistons, sequentially undergoes each of these four cycles.

For each complete engine cycle corresponding to one revolution of the rotors and three revolutions of the crankshaft, there are sixteen induction and compression cycles occurring in respective relatively cold zones, and The four fixed zones of the toroidal cylinder outlined above, are defined by the positions of the opposed pairs of inlet and exhaust ports, and in the case of the spark ignition engine, by the position of the opposed pair or groups of spark plugs. If desired, not all possible working chambers must be utilised, they may be selectively and/or alternately utilised such as by being varied depending upon the power output requirements of the engine.

The size and angular position of the port openings in the toroidal cylinder control the airflow into and out of the working chamber and therefore, the power output potential of the engine. The length of the ports determine their duration of communication with each working chamber, while the angular position of the ports, relative to the working chambers, establishes the port timings. The width of the port finally controls the volume flow rate of air.

The number of rotors in each toroidal cylinder is two, however, the number of toroidal cylinders may be increased by stacking in banks along the crankshaft axis. The number of movements or phases per rotor revolution varies with the number of pistons on each rotor. The number of pistons for each pair of rotors may vary in multiples of four as this corresponds in number with the four cycles of the combustion process. In the engine described herein, there are four pistons on each rotor and therefore, four distinct rotor progressions or movements occur in each revolution of the rotor.

By arranging the axis of the drive pin in the rotor assembly coincident with the pitch circle diameter of the annulus gear, as illustrated in FIG. 14 at 67.5 degree of crankshaft rotation, corresponding to one-half stroke of the pistons, and at 135 degree intervals thereafter, the pistons on one rotor reach their maximum angular velocity while the pistons on the other rotor reach their minimum angular velocity and are effectively stationary. This piston movement within the toroidal cylinder occurs with each of the two rotor assemblies at the same relative position within the cylinder housings and therefore, the operating angular positions of the inlet and outlet ports along with the spark plug positions are established.

The rotational speed of each of the two rotor assemblies varies in a substantially sinusoidal motion from a minimum angular velocity up to a maximum angular velocity and then back to the minimum angular velocity. The pair of rotor assemblies in the eight piston engine, alternately rotate in ninety degree phases, such that the active pistons on one rotor assembly during one phase move rapidly through the respective induction/compression and expansion/exhaust zones of the toroidal cylinder, and thus operate in the manner of conventional pistons, while the reactive pistons of the other rotor assembly move slowly between the respective induction/compression and expansion/exhaust zones of the toroidal cylinder, and thus operate as cylinder closures in the manner of a conventional cylinder head.

Unlike a conventional engine where the piston stops at minimum chamber volume, the pistons in this engine at the minimum chamber volume are moving. The rotor speeds are momentarily identical, and equal to the average rotor speed. In the engine outlined, the average rotor speed is one third crankshaft speed and in the opposite direction.

There are inertia forces exerted by the rotors which act in the opposite direction to the gas pressure forces. These inertia forces result from the mass of the rotors being alternately accelerated and decelerated. However, at any one point in time, the inertia forces of the rotors have the same magnitude as each other but in opposing directions and therefore, they are in balance.

Rotor torque is created by the gas pressures in the combustion chambers reacting equally against the piston faces of both rotor assemblies. The net rotor torque is transferred equally through the drive pins and the bearing blocks to the complementary bearing faces of the slide yokes in the planetary members.

The forces applied through the rotor drive pins to the yoke that produce the crankshaft torque are always equal. The forces however, are applied through constantly changing differential lever lengths that use the crankpin on the crankshaft as a fulcrum. That is, the distance between the centre of the rotating crankpin, to the centre of each drive pin, is referred to as a lever length which constantly changes during rotation of the crankshaft.

When the slide yoke in the planetary member is perpendicular to the crankpin centreline, that is equivalent to top dead centre on a conventional engine, the drive pins have an equal lever length producing no crankshaft torque. After top dead centre (TDC), the differential lever length effectively forces the planetary member to rotate about the crankpin, as illustrated in FIG. 14, at 33.75 degree of crankshaft rotation position. It is evident that the lever length of drive pin A is greater than that of drive pin B.

The planetary member has a planet gear mounted on one end which is in mesh with a stationary annulus gear. When the planetary member is forced to rotate on the crankpin with the gears in mesh, it in turn forces the crankshaft to also rotate generating crankshaft torque.

At the completion of each working cycle, each rotor assembly changes its function from active to reactive, that is, from acting as a piston to acting as a cylinder head. At this instant, the application of the rotor force changes from one slide yoke bearing face to its opposite bearing face in the planetary member. The reaction force generated at the annulus gear does not change in direction as the yoke continues to rotate in the same direction.

The gear ratio of the planet and annulus gear is governed by the number of pistons in the engine. The pitch circle diameter of these gears is determined by the throw of the crankpin. The radial location of the drive pins in the rotors and the throw of the crankpin determine the angular separation of the rotors.

Oil is supplied to the engine by the oil pump mounted in the front cylinder housing and the oil returns to the sump after use via internal drains. The time taken for the oil to reach operating temperature after start-up from cold will be reduced as the oil level in the sump is in intimate contact with the lower water jacket. The increase in the water temperature during engine warm up is utilised by heat transfer through the water jacket in contact with the oil to increase the rate at which the oil is heated, and thereafter to stabilise the oil at the operating water temperature.

It should be noted that an inherent feature of the engine is that near perfect balance should be achievable as there are no reciprocating components. The rotor assemblies and the planetary members, as separate components, will be statically and dynamically balanced in their respective pairs. The planetary member masses are then added to the crankshaft assembly and dynamically balanced by using the counterweight mass at the front and rear of the engine.

It will be seen from the general description so far, that an engine undergoing sixteen combustion processes for three crankshaft revolutions, requiring two main bearings journals, two crankpin bearing journals and two rotor bearing journals only, has the potential to reduce bearing friction compared to that of a corresponding conventional engine. Furthermore, the induction and compression cycles are carried out in respective zones of the toroidal cylinder which remain relatively cool, whereas the combustion and exhaust cycles are carried out in other zones of the toroidal cylinder which remain relatively hot. This physical separation of the hot and cold zones within the toroidal cylinder should increase the efficiency of the induction and expansion processes.

It will also be seen that engine assembly is simplified to facilitate mass production techniques, assembly being to a large extent a stacking process, with most components being layered one upon the other requiring few fasteners to locate the moving components. The engine assembly may be configured for cooling by air, water or oil and it may be disposed with its output shaft axis at any desired angle including horizontal and vertical.

In summary, in the four cycle eight piston version of this engine, ignition occurs at minimum working chamber volume (V/min), in two diametrically opposite working chambers, after compressing a combustible mixture of air and fuel between four of the eight pistons that operate within the toroidal cylinder. The rapid increase in gas pressure within the working chambers exerts a force on the toroidal cylinder, the outer surface of the juxtaposed rotors and the piston faces forcing the leading or active pistons and rotor to accelerate, while simultaneously, forcing the trailing or reactive pistons and rotor to decelerate.

When viewed from the front of the engine, both rotor assemblies rotate in a counter clockwise direction while the crankshaft rotates in a clockwise direction. The two drive pins mounted in the respective rotor assemblies exert equal and opposing forces on the drive yokes through their slide bearing faces at opposite sides of the crankpin. When the slide bearing faces are perpendicular to the plane containing the axis of the crankpin and crankshaft, the drive pins are equidistant from the crankpin and do not force the drive yoke to rotate. However at other positions relative to the crankshaft there is an unequal distance between the crankpin and the opposed drive pins and a turning moment results forcing the planetary member to rotate about the crankpin. As each drive yoke rotates with a planetary gear which is in constant mesh with a stationary annulus gear, this resultant turning moment produces a crankshaft torque.

The internal engine load paths which result in the output torque at the crankshaft are indicated in FIG. 20.

While the engine described above is considered best able to accommodate the expected loads on its components, there may be instances where a higher crankshaft speed is required. In such circumstances, for example, a similar engine having the planet gears meshed externally about a sun gear would provide an engine having its crankshaft rotating at five times the speed of the rotor assemblies.

It will of course be realised, that the above has been given only by way of illustrative example of the invention, and that all such modifications and variations thereto as would be apparent to persons skilled in the art are deemed to fall within the broad scope and ambit of the invention as is defined in the appended claims.

I claim:

1. An internal combustion engine of the type having pistons which move in hesitating progression within a fixed toroidal cylinder formed in a cylinder housing assembly concentrically about a driveshaft, the pistons having sealing means thereabout which engage directly with the wall of the fixed toroidal cylinder such that the hesitating progression of the pistons form expanding and contracting working chambers defined by adjacent pistons and the wall of the fixed toroidal cylinder which has inlet and outlet ports communicating with the exterior of the cylinder housing assembly for entry and exit of fluid to and from the working chambers, and characterized in that:

the toroidal cylinder has an annular access opening thereto extending around its inner peripheral portion;

the driveshaft is supported adjacent its opposite ends by main bearings for rotation about a driveshaft axis in the cylinder housing assembly in which the fixed toroidal cylinder is formed;

the driveshaft has intermediate bearing means concentric with the driveshaft axis and located intermediate the main bearings;

the intermediate bearing means supports a pair of juxtaposed rotors for rotation about the driveshaft axis;

the juxtaposed rotors extend into the annular access opening and operatively close the toroidal shaped cylinder;

the pistons are supported on and extend outwardly from respective ones of the juxtaposed rotors;

the driveshaft has a crankpin offset from the toroidal cylinder axis and disposed between the intermediate bearing means and one of the main bearings;

the crankpin supports a planetary member for rotation thereabout;

the planetary member meshes with complementary fixed drive means associated with the cylinder housing assembly whereby rotation of the driveshaft causes the planetary member to be driven for rotation about the crankpin at a predetermined rotational speed relative to the driveshaft;

each rotor supports a drive pin offset from the intermediate bearing means and disposed with its longitudinal axis parallel to the driveshaft axis;

the drive pins extend into a respective one of a pair of diametrically opposed radial slots formed in the planetary member, and the drive pin from one rotor passes through a window in the other rotor to its respective slot in the planetary member.

2. An internal combustion engine as claimed in claim 1, wherein the access opening is symmetrical about the centerplane containing the toroidal centreline of the toroidal cylinder.

3. An internal combustion engine as claimed in claim 2, wherein the access opening forms a constricted opening to the toroidal cylinder.

4. An internal combustion engine as claimed in claim 3, wherein each end of the driveshaft is exposed at opposite sides of the cylinder housing assembly.

5. An internal combustion engine as claimed in claim 4, wherein the intermediate bearing means extends radially beyond the crankpin.

6. An internal combustion engine as claimed in claim 2, wherein the intermediate bearing means is symmetrical about the centreplane containing the toroidal centreline of the toroidal cylinder.

7. An internal combustion engine as claimed in claim 6, wherein the peripheral faces of the rotors are cylindrical and co-extensive and terminate at the respective opposed junctions between the access opening and the toroidal cylinder.

8. An internal combustion engine as claimed in claim 6, wherein the juxtaposed rotors are identical but arranged opposing one another.

9. An internal combustion engine as claimed in claim 8, wherein each drive pin is accommodated in a boss formed in the respective rotor.

10. An internal combustion engine as claimed in claim 8, wherein the juxtaposed rotors mate at the centreplane containing the toroidal centreline of the toroidal cylinder and the connection between the respective rotor and the pistons thereon extends along a sector of the respective peripheral portion at one side of said centreplane.

11. An internal combustion engine as claimed in claim 6, wherein the cylinder housing assembly includes respective opposed housing portions which mate along the centreplane containing the toroidal centreline of the toroidal cylinder.

12. An internal combustion engine as claimed in claim 11, wherein the inlet and exhaust ports are spaced from the junction of the housing portions.

13. An internal combustion engine as claimed in claim 11, wherein the driveshaft is constrained for counter-rotation relative to the rotors.

14. An internal combustion engine as claimed in claim 13, wherein each pair of rotors has at least the number of pistons which corresponds to the number of cycles of the engine type with increases in piston numbers being in multiples thereof, for each pair of rotors.

15. An internal combustion engine as claimed in claim 13 and configured as a four cycle engine, wherein:

the rotors are driven in the reverse direction to the crankshaft;

the inlet and outlet ports include a pair of diametrically opposed inlet ports and a pair of diametrically opposed outlet ports, and respective inlet and outlet ports are disposed in pairs at respective spaced positions adjacent the position at which pistons form minimum working chamber volumes.

16. An internal combustion engine as claimed in claim 11, wherein the toroidal cylinder has a circular cross section.

17. An internal combustion engine as claimed in claim 1, wherein the planetary member has a planetary gear concentric with the crankpin which meshes with a complementary gear associated with the cylinder housing assembly and disposed concentrically about the driveshaft axis.

18. An internal combustion engine as claimed in claim 1, wherein each drive pin is received rotably in a slide block freely slidable along the respective slot.

19. An internal combustion engine as claimed in claim 18, wherein each slot has a part circular profile whereby the respective slide block is held captive by the slot.

20. An internal combustion engine as claimed in claim 1 and including a duplicate planetary member mounted on a further crankpin disposed coaxially with said crankpin but at the opposite side of the rotors and wherein each drive pin extends through a window in the adjacent rotor to its respective slot in each planetary member.

21. An internal combustion engine as claimed in claim 1, wherein the inlet and exhaust ports are positioned in a side wall portion of the cylinder away from the outer peripheral wall portion of the cylinder.

22. An internal combustion engine as claimed in claim 1, wherein the crankpin and the intermediate bearing means are formed integrally and each main bearing journal adjacent a crankpin is formed as a removable main bearing journal which fixes eccentrically to an end projection of the crankpin.

23. An internal combustion engine of the type having pistons which move in hesitating progression within a fixed toroidal cylinder formed concentrically about a driveshaft, the pistons having sealing means thereabout which engage directly with the wall of the fixed toroidal cylinder such that the hesitating progression of the pistons form expanding and contracting working chambers defined by adjacent pistons and the wall of the fixed toroidal cylinder which has inlet and outlet ports for entry and exit of fluid to and from the working chambers, and characterized in that:

the toroidal cylinder has an annular access opening thereto extending around its inner peripheral portion;

the driveshaft is supported adjacent its opposite ends by main bearings for rotation about a driveshaft axis in a cylinder housing assembly in which the fixed toroidal cylinder is formed;

the driveshaft has intermediate bearing means concentric with the driveshaft axis and located intermediate the main bearings;

the intermediate bearing means supports a pair of juxtaposed rotors for rotation about the driveshaft axis;

the juxtaposed rotors extend into the annular access opening and operatively close the toroidal shaped cylinder;

the pistons are supported on and extend outwardly from respective ones of the juxtaposed rotors;

the driveshaft has a crankpin offset from the toroidal cylinder axis and disposed between the intermediate bearing means and one of the main bearings;

the crankpin supports a planetary member for rotation thereabout;

the planetary member meshes with complementary fixed drive means associated with the cylinder housing assembly whereby rotation of the driveshaft causes the planetary member to be driven for rotation about the crankpin at a predetermined rotational speed relative to the driveshaft;

a respective drive connection between each rotor and the planetary member offset from their respective axes whereby the differential angular velocity of each drive connection about the driveshaft axis resultant from the epicyclic motion of the planetary member causes the pistons of the rotors to move cyclically toward and away from one another as the rotors rotate in hesitating progression about the driveshaft.

24. An internal combustion engine as claimed in claim 23, wherein the direct drive connection is a drive pin which is located fixedly in one of either the planetary member or a rotor and which is slidably received in a respective radial slot in the other.

25. An internal combustion engine as claimed in claim 23, wherein the driveshaft assembly extends between the housing portions and is rotably mounted in the respective opposed housing portions by loading opposite ends of the driveshaft axially into the respective opposed housing portions from the interior thereof, and wherein the drive connection comprises components which may be operatively assembled over the driveshaft from one or respective opposite ends thereof by interengagement of components in an axial direction whereby the rotary positive displacement apparatus may be readily assembled by sequentially adding components in an axial direction into operative engagement with one another.

26. An internal combustion engine as claimed in claim 23, wherein:

the pistons are supported in equal numbers on a pair of juxtaposed rotors, the total number of pistons being a multiple of four, the pistons being disposed equidistant about each respective rotor;

the inlet and outlet ports comprise an inlet port and an outlet port for each four pistons;

the inlet and outlet ports are disposed at respective spaced positions at which adjacent pistons form minimum working chamber volumes whereby each inlet port successively opens in a constant timed relationship to an expanding working chamber and each outlet port means successively opens in a constant timed relationship to a contracting working chamber.

27. An internal combustion engine as claimed in claim 23, wherein the pistons are part-circular in profile and each has a piston ring seal extending about its part-circular portion and engaging with the wall of the fixed toroidal cylinder and a further seal which engages the portion of the opposing rotor exposed within said annular access opening.

28. An internal combustion engine of the type having pistons which move in hesitating progression within a fixed toroidal cylinder formed concentrically about a driveshaft, the pistons having sealing means thereabout which engage directly with the wall of the fixed toroidal cylinder such that the hesitating progression of the pistons form expanding and contracting working chambers defined by adjacent pistons and the wall of the fixed toroidal cylinder which has inlet and outlet ports for entry and exit of fluid to and from the working chambers, and characterized in that:

the toroidal cylinder has an annular access opening thereto extending around its inner peripheral portion;

the driveshaft is supported adjacent its opposite ends by main bearings for rotation about a driveshaft axis in a cylinder housing assembly in which the fixed toroidal cylinder is formed;

juxtaposed rotors extending into the annular access opening and operatively close the toroidal shaped cylinder;

the pistons are supported on and extend outwardly from respective ones of the juxtaposed rotors;

the driveshaft has a crankpin offset from the toroidal cylinder axis and disposed between the intermediate the main bearings;

the crankpin supports a planetary member for rotation thereabout;

the planetary member meshes with complementary fixed drive means associated with the cylinder housing assembly whereby rotation of the driveshaft causes the planetary member to be driven for rotation about the crankpin at a predetermined rotational speed relative to the driveshaft;

each rotor supports a drive pin offset from the driveshaft axis and disposed with its longitudinal axis parallel to the driveshaft axis;

the drive pins extend into a respective radial slot arranged symmetrically about the planetary member, and the drive pin of each rotor blocked from the planetary member by another rotor passes through a window in each blocking rotor to a respective slot in the planetary member.

29. An internal combustion engine as claimed in claim 28, wherein the driveshaft has intermediate bearing means on which the rotors are mounted, the intermediate bearing means being concentric with the driveshaft axis and located intermediate the main bearings.

30. An internal combustion engine of the type having pistons which move in hesitating progression within a fixed toroidal cylinder formed in a cylinder housing assembly concentrically about a driveshaft, the pistons having sealing means thereabout which engage directly with the wall of the fixed toroidal cylinder such that the hesitating progression of the pistons form expanding and contracting working chambers defined by adjacent pistons and the wall of the fixed toroidal cylinder which has inlet and outlet ports communicating with the exterior of the cylinder housing assembly for entry and exit of fluid to and from the working chambers, and characterized in that:

the toroidal cylinder has an annular access opening thereto extending around its inner peripheral portion;

the driveshaft is supported adjacent its opposite ends by main bearings for rotation about a driveshaft axis in the cylinder housing assembly in which the fixed toroidal cylinder is formed;

the driveshaft has intermediate bearing means concentric with the driveshaft axis and located intermediate the main bearings;

the intermediate bearing means supports a pair of juxtaposed rotors for rotation about the driveshaft axis;

the juxtaposed rotors extend into the annular access opening and operatively close the toroidal shaped cylinder;

the pistons are supported on and extend outwardly from respective ones of the juxtaposed rotors;

the driveshaft has respective crankpins offset from the toroidal cylinder axis and disposed between the intermediate bearing means and a respective one of the main bearings;

each crankpin supports a planetary member for rotation thereabout;

each planetary member meshes with complementary fixed drive means associated with the cylinder housing assembly whereby rotation of the driveshaft causes the planetary members to be driven for rotation in unison about their respective crankpin at a predetermined rotational speed relative to the driveshaft;

each rotor supports a drive pin offset from the intermediate bearing means and disposed with its longitudinal axis parallel to the driveshaft axis;

the drive pins extend into a respective one of a pair of diametrically opposed radial slots formed in each planetary member, and the drive pins from each rotor pass through a window in the other rotor to its respective slot in one planetary member.

* * * * *